US010200794B2

(12) United States Patent
Oliaei

(10) Patent No.: US 10,200,794 B2
(45) Date of Patent: Feb. 5, 2019

(54) ULTRASONIC OPERATION OF A DIGITAL MICROPHONE

(71) Applicant: INVENSENSE, INC., San Jose, CA (US)

(72) Inventor: Omid Oliaei, Sunnyvale, CA (US)

(73) Assignee: INVENSENSE, INC., San Jose, CA (US)

( * ) Notice: Subject to any disclaimer, the term of this patent is extended or adjusted under 35 U.S.C. 154(b) by 622 days.

(21) Appl. No.: 14/737,900

(22) Filed: Jun. 12, 2015

(65) Prior Publication Data

US 2016/0192084 A1 Jun. 30, 2016

Related U.S. Application Data

(60) Provisional application No. 62/098,412, filed on Dec. 31, 2014.

(51) Int. Cl.

| | |
|---|---|
| ***E21B 47/16*** | (2006.01) |
| ***H04R 19/00*** | (2006.01) |
| ***H04R 3/06*** | (2006.01) |

(52) U.S. Cl.

CPC ..... *H04R 19/005* (2013.01); *H04R 3/06* (2013.01); *H04R 2201/003* (2013.01); *H04R 2430/03* (2013.01)

(58) Field of Classification Search

None

See application file for complete search history.

(56) References Cited

U.S. PATENT DOCUMENTS

| | | | | |
|---|---|---|---|---|
| 9,076,447 | B2 * | 7/2015 | Nandy | G10L 19/002 |
| 9,332,369 | B2 * | 5/2016 | Jenkner | H04R 1/08 |
| 9,419,562 | B1 * | 8/2016 | Melanson | H03M 3/424 |
| 9,577,663 | B1 * | 2/2017 | Paton Alvarez | H03M 3/464 |
| 9,618,361 | B2 * | 4/2017 | Opris | G01C 25/00 |

(Continued)

FOREIGN PATENT DOCUMENTS

| | | | | |
|---|---|---|---|---|
| JP | 3668179 | B2 * | 7/2005 | |
| WO | WO-9207346 | A1 * | 4/1992 | G01S 5/186 |

OTHER PUBLICATIONS

Steele, Brenton, and Peter O'Shea. "A reduced sample rate bandpass sigma delta modulator." Signal Processing and Its Applications, 1999. ISSPA'99. Proceedings of the Fifth International Symposium on. vol. 2. IEEE, 1999. (Year: 1999).*

(Continued)

*Primary Examiner* — Isam A Alsomiri
*Assistant Examiner* — Jonathan D Armstrong
(74) *Attorney, Agent, or Firm* — Amin, Turocy & Watson, LLP

(57) ABSTRACT

Detection of audible and ultrasonic signals is provided by a microelectromechanical microphone. The detection range of ultrasonic signals can be configurable. In certain embodiments, the microelectromechanical microphone can include a band-pass sigma-delta modulator that can generate a digital signal representative of an ultrasonic signal. In addition or in other embodiments, the microelectromechanical microphone can include an event detector device that can determine that an ultrasonic event has occurred and, in response, can send a control signal to an external device. Detection of ultrasonic signals can be utilized in vehicular applications and/or gesture recognition.

19 Claims, 14 Drawing Sheets

(56) References Cited

U.S. PATENT DOCUMENTS 9,866,938 B2 * 1/2018 Popper ..... H04R 1/04
2007/0160234 A1 * 7/2007 Deruginsky ..... H02M 3/073 381/113
2008/0303703 A1 * 12/2008 Josefsson ..... H03M 3/47 341/143
2009/0066549 A1 * 3/2009 Thomsen ..... H03M 3/482 341/143
2009/0316935 A1 * 12/2009 Furst ..... H03F 1/3211 381/111
2010/0315272 A1 * 12/2010 Steele ..... G01D 3/032 341/110
2011/0242305 A1 * 10/2011 Peterson ..... G01S 15/003 348/77
2013/0271307 A1 * 10/2013 Kropfitsch ..... H03G 3/002 341/158
2014/0177874 A1 * 6/2014 Bogason ..... H04R 1/005 381/111
2015/0125004 A1 * 5/2015 Cagdaser ..... H04R 3/00 381/111
2015/0146885 A1 * 5/2015 Fitzgerald ..... H04R 3/005 381/98
2015/0281836 A1 * 10/2015 Nguyen ..... H04R 3/00 381/120
2016/0041941 A1 * 2/2016 Kessler ..... G06F 13/4282 700/3
2016/0134973 A1 * 5/2016 Oliaei ..... H04R 17/02 381/114
2016/0192084 A1 * 6/2016 Oliaei ..... H04R 3/06 367/135
2016/0249122 A1 * 8/2016 Popper ..... H04R 1/04
2017/0223450 A1 * 8/2017 Paton Alvarez ..... H03F 1/0211
2017/0245035 A1 * 8/2017 Lee ..... H04R 1/04
2018/0031597 A1 * 2/2018 Oliaei ..... B81B 7/008

OTHER PUBLICATIONS

Qin, Lisheng, Kamal El-Sankary, and Mohamad Sawan. "A 1.8 V CMOS fourth-order Gm-C bandpass sigma-delta modulator dedicated to front-end ultrasonic receivers." Solid-State and Integrated Circuits Technology, 2004. Proceedings. 7th International Conference on. vol. 2. IEEE, 2004. (Year: 2004).*

Campbell Scientific Inc. Anti-Alias Filter & FFT Spectrum Analyzer Modules Models CR9052IEPE & CR9052DC. Printed Aug. 2005. (Year: 2005).*

Eric Ericson Fabris. A Modular and Digitally Programmable Interface Based on Band-Pass Sigma-Delta Modulator for Mixed-Signal Systems-On-Chip. Dissertation. Jul. 2005.*

Analog Devices. Omnidirectional Microphone with Bottom Port and I2S Digital Output. Data Sheet ADMP441. 2012.*

Analog Devices. High Performance Digital MEMS Microphone Standard Digital Audio Interface to Blackfin DSP. Circuit Note CN-0266. 2012.*

Christen, Thomas. "A 15-bit [ . . . ] Scalable-Bandwidth Inverter-Based [sigma-delta] Modulator for a MEMS Microphone With Digital Output." IEEE Journal of Solid-State Circuits 48.7 (2013): 1605-1614.*

Analog Devices. SigmaDSP Digital Audio Processor with Flexible Audio Routing Matrix Data Sheet ADAU1442/ADAU1445/ADAU1446. 2013.*

International Search Report and Written Opinion dated Jun. 6, 2016 for PCT Application Serial No. PCT/US2015/067414, 22 pages.

* cited by examiner

ULTRASONIC OPERATION OF A DIGITAL MICROPHONE

CROSS-REFERENCE TO RELATED APPLICATION

The present application claims priority to U.S. Provisional Patent Application No. 62/098,412, filed Dec. 31, 2014, the content of which application is hereby incorporated herein by reference in its entirety.

BACKGROUND

Microelectromechanical microphones typically operate in an audible band of frequencies, and also can operate at ultrasonic frequencies. Analog microelectromechanical microphones can include an electro-acoustic sensor that can convert acoustic signals into an electrical signal, and an amplifier that can amplify the electrical signal. Thus, to permit detection of an ultrasonic signal in an analog microelectromechanical microphone, it can suffice that the electro-acoustic sensor, the amplifier, and an acoustic channel of the analog microelectromechanical microphone have a bandwidth extending into ultrasonic frequencies.

In contrast, digital microelectromechanical microphones include an analog-to-digital (A/D) converter that can convert an analog electric signal into a digital signal. The A/D converter can introduce quantization noise into the digital signal through a noise shaping process in which an amount of quantization in the signal band can be mitigated by pushing the low-frequency noise to high frequencies. As such, in the presence of an ultrasonic signal, a noise shaping range of a digital microelectromechanical microphone may be required to extend to frequencies significantly higher than the audible band of frequencies. Therefore, conventional digital microelectromechanical microphones typically increase a clock frequency of the A/D converter and, optionally, another clock frequency of a device that can format output digital signals. Such an approach can be inefficient in terms of noise shaping and can result in high power consumption because ultrasonic signals are usually narrowband and, therefore, a large portion of the increase in clock frequency leveraged for noise quantization is not applied to frequencies that carry meaningful information. Further, when a maximum available clock frequency in the circuitry associated with the digital microelectromechanical microphone is limited, signal-to-noise ratio can significantly degrade for high-frequency ultrasonic signals.

SUMMARY

The following presents a simplified summary of one or more of the embodiments in order to provide a basic understanding of one or more of the embodiments. This summary is not an extensive overview of the embodiments described herein. It is intended to neither identify key or critical elements of the embodiments nor delineate any scope of embodiments or the claims. Its sole purpose is to present some concepts of the embodiments in a simplified form as a prelude to the more detailed description that is presented later. It will also be appreciated that the detailed description may include additional or alternative embodiments beyond those described in the Summary section.

This disclosure recognizes and addresses, in at least certain embodiments, the issue of detection of ultrasonic signals in microelectromechanical microphones. Detection of ultrasonic signals can be utilized in vehicular applications and/or gesture recognition. In one embodiment, the disclosure can provide a digital microelectromechanical microphone, including an electro-acoustic sensor that can receive an acoustic signal including an ultrasonic signal. The electro-acoustic sensor can generate an electric output signal representative of the acoustic signal. The microelectromechanical microphone also can include an amplifier that can generate a second electric output signal using the first electric output signal. The microelectromechanical microphone can further include a band-pass sigma-delta modulator that can receive the second electric output signal, and can generate a digital output signal representative of the ultrasonic signal. The digital output signal can be generated using the second electric output signal. In addition or in other embodiments, the acoustic signal also can include an audible signal and the amplifier can generate a third electric output signal. The microelectromechanical microphone also can include a low-pass sigma-delta modulator that can generate another digital output signal representative of the audible signal. Such a digital output signal can be generated using the third electric output signal. It can be readily appreciated that such a microelectromechanical microphone can permit independently adjusting, e.g., optimizing, the band-pass sigma-delta modulator for ultrasonic signals and the low-pass sigma-delta modulator for audible signals.

Other embodiments and various examples, scenarios, and implementations are described in more detail below. The following description and the drawings set forth certain illustrative embodiments of the specification. These embodiments are indicative, however, of but a few of the various ways in which the principles of the specification may be employed. Other advantages and novel features of the embodiments described will become apparent from the following detailed description of the specification when considered in conjunction with the drawings.

DETAILED DESCRIPTION

Figure 1:
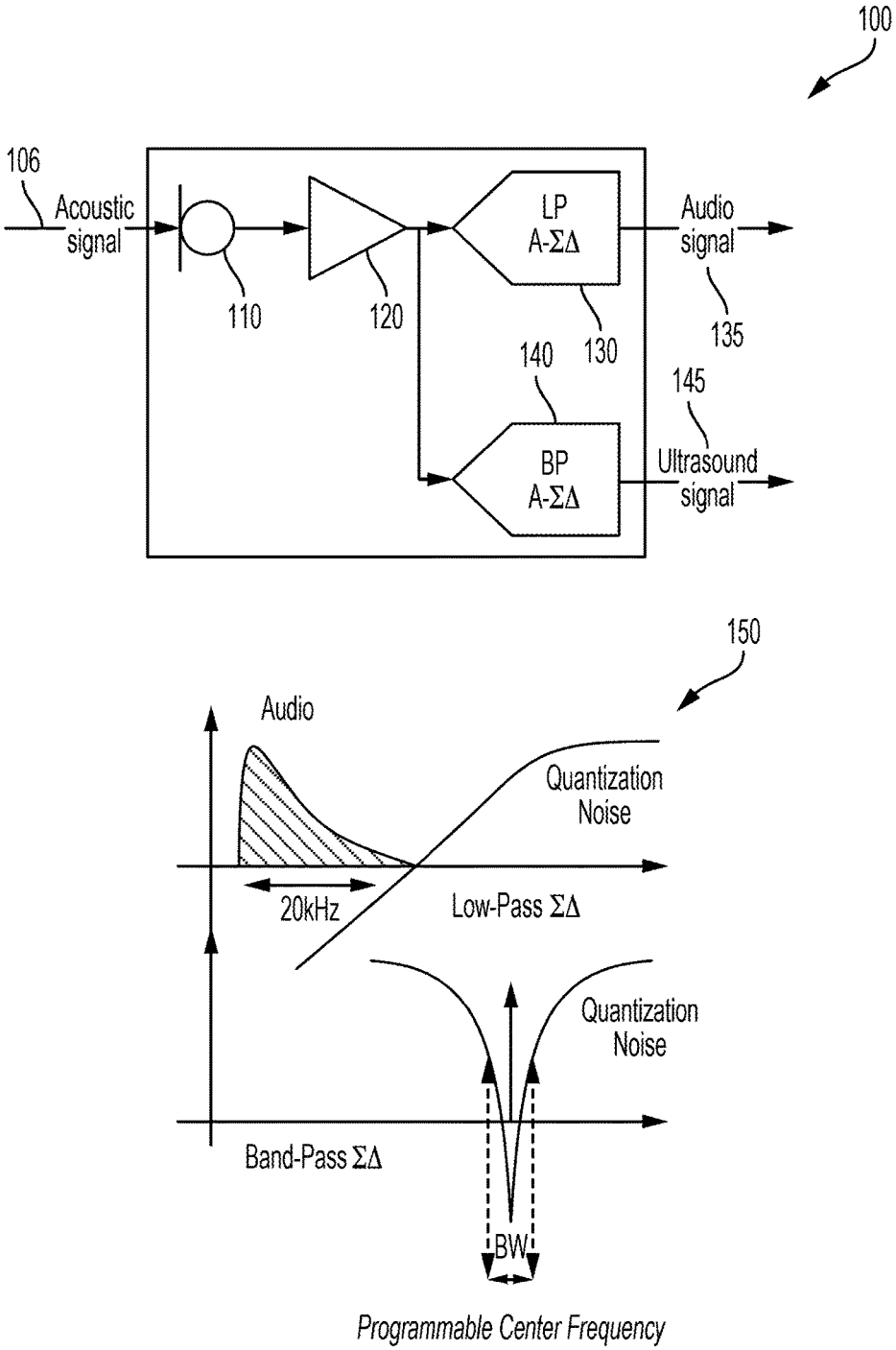
FIG. 1 presents an example of a microelectromechanical microphone and operation associated operation principles in accordance with one or more embodiments of the disclosure.

The disclosure is now described with reference to the drawings, wherein like reference numerals are used to refer to like elements throughout. In the following description, for purposes of explanation, numerous specific details are set forth in order to provide a thorough understanding of this disclosure. It may be evident, however, that the disclosure may be practiced without these specific details. In other instances, well-known structures and devices are shown in block diagram form in order to facilitate describing the disclosure. This disclosure recognizes and addresses, in at least certain embodiments, the issue of detection of ultrasonic signals. Detection of ultrasonic signals can be utilized in vehicular applications and/or gesture recognition. As described in greater detail below, embodiments of the disclosure permit detection of audible and ultrasonic signals is provided by a microelectromechanical microphone. The detection range of ultrasonic signals can be configurable. In certain embodiments, the microelectromechanical microphone can include a band-pass sigma-delta modulator that can generate a digital signal representative of an ultrasonic signal. In addition or in other embodiments, the microelectromechanical microphone can include an event detector device that can determine that an ultrasonic event has occurred and, in response, can send a control signal to an external device. Detection of ultrasonic signals can be utilized in vehicular applications and/or gesture recognition.

With reference to the drawings, FIG. 1 presents an example of a microelectromechanical microphone 100 in accordance with one or more embodiments of the disclosure. As illustrated, the microelectromechanical microphone 100 includes an electro-acoustic sensor 110 that can receive a pressure wave, which can propagate an acoustic signal 106, and can generate an electric output signal, which generally is an analog electric signal. In certain embodiments, the electric output signal can be generated via capacitive sensing (differential or otherwise). As such, the electro-acoustic sensor can include a movable plate (e.g., a flexible diaphragm) and stationary plate(s) (e.g., a backplate(s)) that can permit generation of a capacitive signal in response to the pressure wave. Regardless the specific manner in which it is generated, the electric output signal is representative of the acoustic signal 106, which can include an audible signal and/or an ultrasonic signal. In addition, the microelectromechanical microphone 100 includes an amplifier 120 that functionally coupled (e.g., electrically coupled) to the electro-acoustic sensor 110. The amplifier 120 can receive the electric output signal generated by the electro-acoustic sensor 110, and can generate a second electric output signal based at least on the electric output signal.

The second electric output signal can be analog, and the microelectromechanical microphone 100 can convert such a signal to a digital signal. To that end, in at least certain embodiments, the microelectromechanical microphone 100 can include a low-pass sigma-delta modulator 130 and a band-pass sigma-delta modulator 140. The low-pass sigma-delta modulator 130 can receive the second electric output signal and can generate a first digital output signal 135 based at least on the second electric output signal. The first digital output signal 135 can be representative or otherwise indicative of an audible signal included in the acoustic signal 106. As such, first digital output signal 135 can be referred to as audio signal 135. In one implementation, the low-pass sigma-delta modulator 130 can embody or can include a single-bit sigma-delta modulator. As depicted in panel 150 in FIG. 1, the low-pass sigma-delta modulator 130 can introduce quantization noise into the first digital output signal 135 through a noise shaping process in which the amount of quantization noise can be reduced by rejecting it to high-frequency noise. Noise shaping over the audio band can easily be accomplished because of a small bandwidth of 20 kHz.

In addition, the band-pass sigma-delta modulator 140 can receive the second electric output signal, and can generate a second digital output signal 145 based at least on the second electric output signal. The second digital output signal 145 can be representative or otherwise indicative of an ultrasonic signal included in the acoustic signal 106. Therefore, the second digital output signal 145 can be referred to as ultrasonic signal 145. The band-pass sigma-delta modulator 140 can have a specific center frequency and a specific bandwidth, either one or both of which can be configurable or otherwise programmable in order to accommodate various ultrasonic frequencies. The bandwidth can be defined with respect to the center frequency. For example, the center frequency can be at about 58 kHz and the bandwidth can be equal to about 4 kHz. Therefore, in one aspect, the band-pass sigma-delta modulator 140 can reject quantization noise to frequencies outside the bandwidth with respect to the center frequency. The band-pass sigma-delta modulator 140 can be embodied in or can include, for example, a second-order or higher-order sigma-delta modulator. In one implementation, the band-pass sigma-delta modulator 140 can embody or can include a single-bit sigma-delta modulator. In another implementation, the band-pass sigma-delta modulator 140 can embody or can include a multi-bit sigma-delta modulator. In addition or in other implementations, the band-pass sigma-delta modulator 140 can be embodied in or can include a discrete-time sigma-delta modulator or a continuous-time sigma-delta modulator. The band-pass sigma-delta modulator 140 can utilize or otherwise leverage the same or a different clock frequency than that utilized by the low-pass sigma-delta modulator 130 for the audible portion of the acoustic signal 106.

The low-pass sigma-delta modulator 130 can format the audio signal 135 according to one of a pulse density modulation (PDM) format, an inter-IC sound ($I^2S$) controller format, a time division multiplexing (TDM) format, a SoundWire format, a SlimBus format, or any other format suitable for generation of a digital signal that can be consumed by a disparate device. Similarly, the band-pass sigma-delta modulator 140 can format the ultrasonic signal 145 according to one of a PDM format, an $I^2S$ controller format, a TDM format, a SoundWire format, a SlimBus format, or any other format for generation of a digital signal.

By fitting or otherwise configuring the microelectromechanical microphone 100 with separate A/D converters that can generate digital signals from analog signals having disparate frequencies, the processing of an audible portion of an acoustic signal can be decoupled from the processing of an ultrasonic portion thereof. Not only can such a decoupling permit accurate processing of the both audible and ultrasonic signals, but in certain embodiments, it also can permit detecting presence of an ultrasonic signal—which can represent, in one example, an ultrasonic event.

Figure 2:
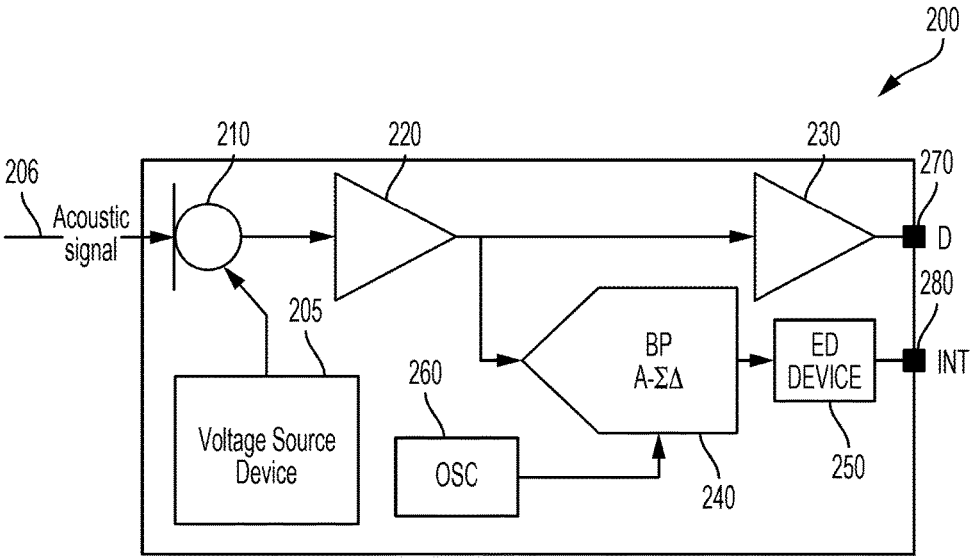
FIGS. 2-3 present other examples of a microelectromechanical microphone in accordance with one or more embodiments of the disclosure.

Specifically, as an illustration, FIG. 2 presents an example of a microelectromechanical microphone 200 that can detect an ultrasonic event. Such a microphone can include an electro-acoustic sensor 210 can receive a pressure wave, which can include an acoustic signal 206, and can generate an electric output signal representative of the acoustic signal 206. The electric output signal is analog and can be embodied in or can include a single-ended output signal or a differential output signal. To that end, one or more components of the electro-acoustic sensor 210 can be biased by a voltage source device 205 (e.g., a charge pump) or another type of voltage source device. For instance, an electrode formed in a movable plate of the electro-acoustic sensor 210 and an electrode formed in a stationary plate of the electro-acoustic sensor 210 can be respectively biased by the voltage source device 205. An amplifier 220 can receive the electric output signal and can generate an amplified electric output signal that can be supplied to a second amplifier 230 for further amplification and output via a pin 270 or another type output interface. The amplified electric output signal also can be supplied to a band-pass sigma-delta modulator 240 that can generate a digital output signal based at least on the amplified electric outputs signal. In certain embodiments, the band-pass sigma-delta modulator 240 can receive a clock signal from self-oscillating oscillator 260.

The digital output signal generated by the band-pass sigma-delta modulator 240 can be supplied to an event detector (ED) device 250 that can process the digital output signal. The ED device 250 can be embodied in or can include a digital signal processor (DSP) or another type of processor that can apply detection logic configured to determine if an ultrasonic event has occurred. The ultrasonic event can be embodied in or can include, for example, presence or absence of an ultrasonic signal in the acoustic signal 206; presence of an ultrasonic signal having a magnitude that exceeds a certain threshold or having another type of metric that satisfies a specific criterion; presence of an ultrasonic signal having a defined feature and/or pattern of defined features; a combination of the foregoing; or the like. In response to ascertaining that the ultrasonic event is present, the microelectromechanical microphone 200 can generate an interrupt signal that can be output via a pin 280 or another type of output interface. The interrupt signal can be sent to a host device, such as a codec device, a sensor hub, or an application processor (AP).

Figure 3:
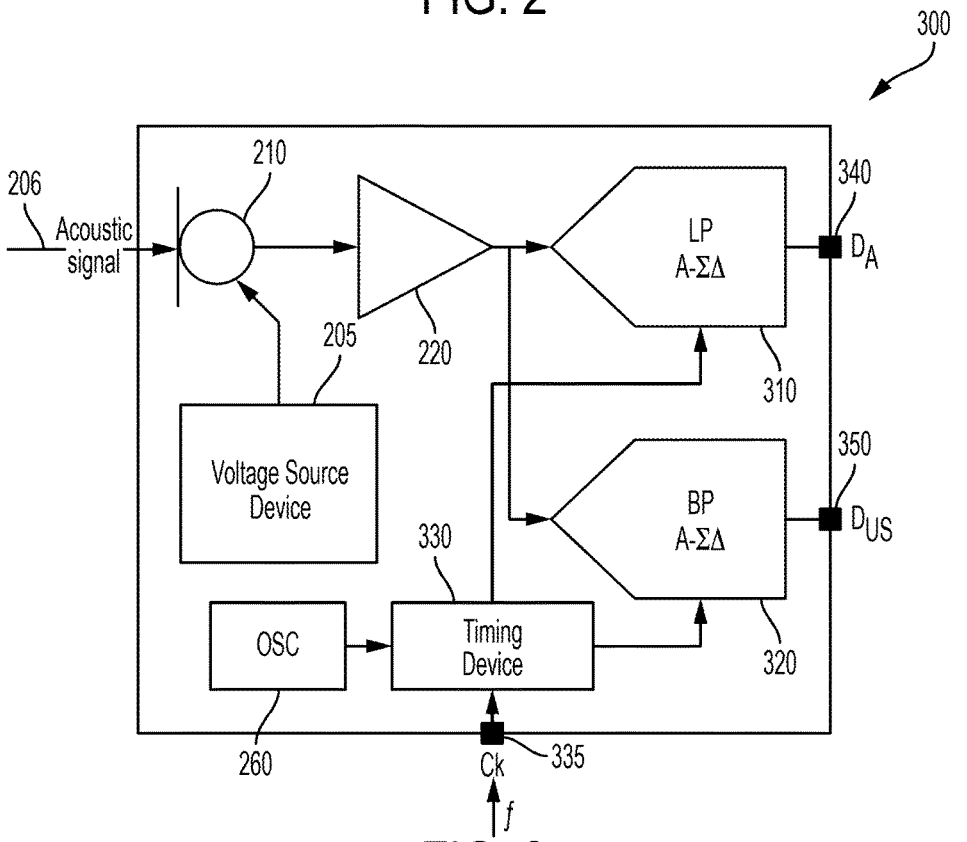

Decoupling the generation of a digital signal associated with an audible portion of an acoustic signal from the generation of another digital signal associated with an ultrasonic portion of the acoustic signal can afford improved operational flexibility. FIG. 3 illustrates an example of a microelectromechanical microphone 300 in accordance with one or more embodiments of the disclosure. As illustrated, a low-pass sigma-delta modulator 310 and a band-pass sigma-delta modulator 320 can receive an analog electric output signal from the electro-acoustic sensor 210. Similar to other modulators described herein, the low-pass sigma-delta modulator 310 and the band-pass sigma-delta modulator 320 can generate, respectively, a digital output signal $D_A$ and a digital output signal $D_{US}$. To that end, in the illustrated embodiment, a timing device 330 can provide a clock signal having a defined clock frequency to the low-pass sigma-delta modulator 310, and another clock signal having another defined clock frequency to the band-pass sigma-delta modulator 320. As such, the low-pass sigma-delta modulator 310 and the band-pass sigma-delta modulator 320 can function independently at two different clock frequencies. To provide a specific clock signal having a defined clock frequency, the timing device 330 can receive a reference clock signal (represented with label "Ck" in FIG. 3) having a reference frequency f from the oscillating device 260 or from an external component (e.g., a codec device or an oscillator), via a pin 335 or another type of input interface.

Similar to other microphones of this disclosure, digital output signal $D_A$ and digital output signal $D_{US}$ generated in the microelectromechanical microphone 300 can be output via a pin 340 and a pin 350, respectively. Other types of output interfaces also can be configured to output digital output signal $D_A$ and/or digital output signal $D_{US}$. In addition, the microelectromechanical microphone 400 also includes a pin 418 and a pin 412 that can be utilized, respectively, to provide an electric ground and to configure (e.g., receive or provide or otherwise supply) a defined voltage in the electromechanical microphone 400.

Figure 4:
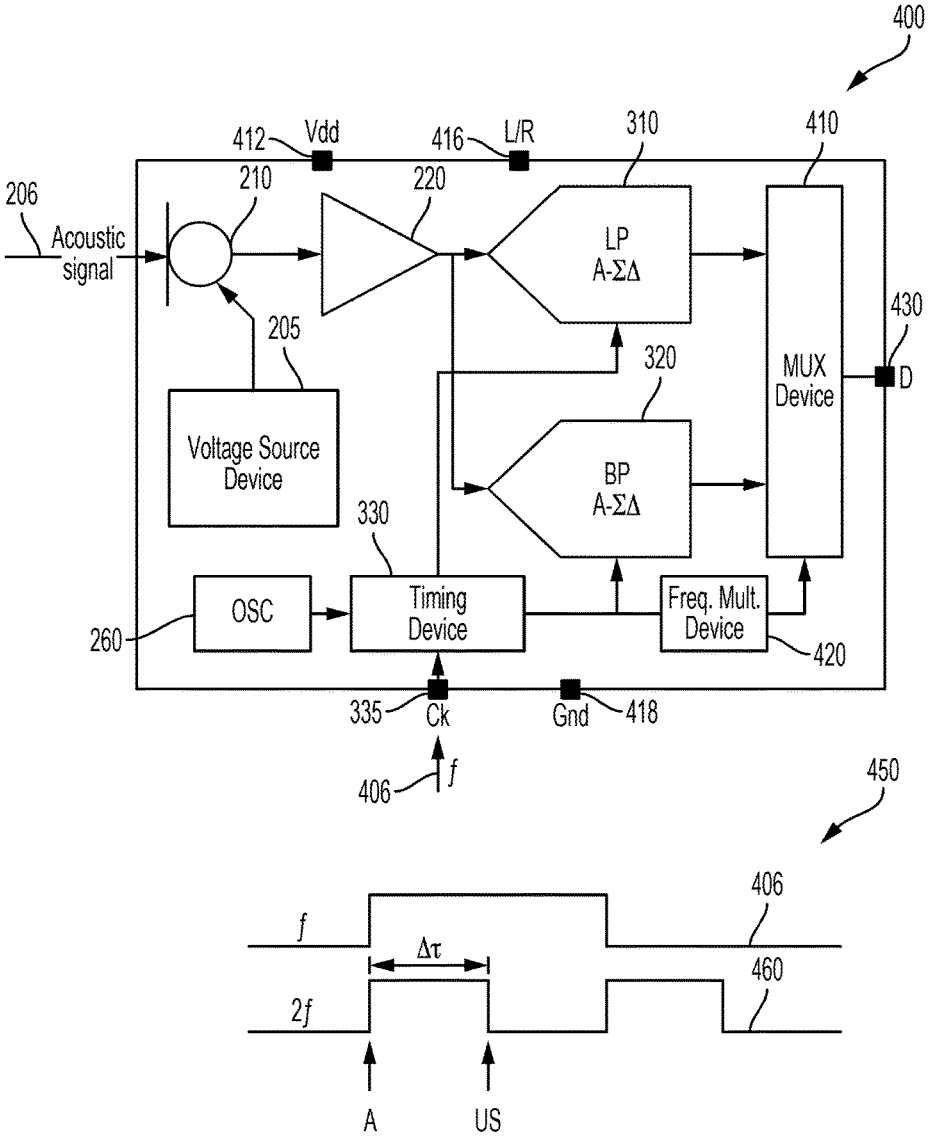
FIG. 4 presents an example of a microelectromechanical microphone and related clock signals in accordance with one or more embodiments of the disclosure.

In certain embodiments, the output of digital signals can be multiplexed. Multiplexing can simplify integration of microelectromechanical microphones of this disclosure into other equipment. FIG. 4 illustrates an example of a microelectromechanical microphone 400 and related timing signals in accordance with one or more embodiments of the disclosure. As illustrated, the timing device 330 can receive an input clock signal 406 having an input clock frequency f (where f is a positive real number). In one example, f can be about 2.4 MHz. The input clock signal 406 can be received from an external component, such as a codec device. In one implementation, each of the low-pass sigma-delta modulator 310 and the band-pass sigma-delta modulator 320 can operate at the input clock frequency f. In addition or in other implementations, each of the low-pass sigma-delta modulator 310 and the band-pass sigma-delta modulator 320 can provide a single-bit output, and can generate a PDM bitstream at the clock frequency f (e.g., 2.4 MHz). In addition, a frequency multiplier device 420 can receive the input clock signal and can generate a timing signal having a frequency g that is a multiple of the clock frequency f: g=mf, where g is a real number and m a natural number. The frequency multiplier device can utilize or otherwise leverage a delay-locked loop (DLL) or a phase-locked loop (PLL) to generate such a timing signal. Specifically, in certain embodiments, the frequency multiplier device 420 can double (e.g., m=2) the input clock frequency f via a delay-locked loop (DLL) or a phase-locked loop (PLL).

The timing signal generated by the frequency multiplier device 420 can be input into a multiplexer device 410 that can multiplex the two-bit stream at a rate commensurate with the frequency g of the timing signal. For instance, the multiplexer device 410 can multiplex the two-bit stream at double the rate of the input clock signal: For f=2.4 MHz, g=4.8 MHz and the rate at which the two-bit stream is multiplexed is about 0.21 μs. As such, the microelectromechanical microphone 400 can output two bits in a single stream: one bit for audio and one bit for ultrasound. The signal generated by the multiplexer device 410 can be output via a pin 430. Other types of output interfaces also can be configured to output digital output signal D. As an example, in a scenario in which the left/right (L/R) select pin 416 of the microphone is tied to a voltage pin $V_{dd}$ 412, the microelectromechanical microphone 400 can operate on the left channel and the two output bits (audio and ultrasound) can be generated on rising edge of the input clock signal 406. Thus, the two output bits can be separated by a time interval $\Delta\tau=(4f)^{-1}$, corresponding to a quarter-period of the input clock signal. Diagram 450 in FIG. 4 illustrates the input clock signal 406 and a timing signal 460 (with a square waveform) corresponding to a doubled input clock signal, where the audio (A) and ultrasound (US) bits can be formed at the rising edge of the input clock signal 406.

The multiplexing of digital output signals as described in connection with the example microelectromechanical microphone 400 can be utilized to arrange two microphones in a stereophonic configuration in which the two microphones can share a single data line for communication with a codec device. One of the two microphones can correspond to a first channel (e.g., left (L) channel) and the other can correspond to a second channel (e.g., right (R) channel). The stereophonic configuration is illustrated in diagram 500 in FIG. 5. A microelectromechanical microphone 502*a* corresponds to the first channel and a microelectromechanical microphone 502*b* corresponds to the second channel. A codec device 504 can provide a clock signal to each of the microelectromechanical microphone 502*a* and the microelectromechanical microphone 502*b* via a clock line 506. The clock signal can have a clock frequency f (e.g., 2.4 MHz, 768 kHz, or 384 kHz). In addition, the codec device 504 can receive multiplexed digital output signal from both the microelectromechanical microphone 502*a* and the microelectromechanical microphone 502*b* in a data line 508. In certain embodiments, a data stream that is received at the codec device 504 can have a frequency g determined by rate of multiplexing at each of such microphones. For instance, g can be twice the clock frequency f of the clock signal.

In certain implementations, the microelectromechanical microphone 502*a* (which can be referred to as the L-channel microphone) can generate two successive output bits (one audio bit and one ultrasound bit) on a rising edge of the clock signal. In addition, the microelectromechanical microphone 502*b* (which can be referred to as the R-channel microphone) can generate two successive output bits (one audio and one ultrasound bit) on the falling edge of the clock. To that end, the microelectromechanical microphone 502*a* can include an electro-acoustic sensor 512*a* configured to receive a pressure wave, and a voltage source device 510*a*. The microelectromechanical microphone 502*a* also can include an amplifier 514*a* that receives an output signal from the electro-acoustic sensor 512*a*. In accordance with aspects of this disclosure, the microelectromechanical microphone 502*a* includes a low-pass sigma-delta modulator 516*a* and a band-pass sigma-delta modulator 518*a*. A timing device 520*a* is coupled to such modulators and can provide a timing signal to each of the low-pass sigma-delta modulator 516*a* and the band-pass sigma-delta modulator 518*a*. The timing signal generated by the timing device 520*a* can be output to a frequency multiplier 524*a*. For the sake of illustration, the frequency multiplier 524*a* is shown as an m=2 multiplier and can double the frequency of the timing signal output by the timing device 520*a*. In accordance with further aspects of this disclosure, the microelectromechanical microphone 502*a* can include a multiplexer device 522*a* that can generate a digital output signal as described herein in connection with FIG. 4, for example, or other embodiments of this disclosure. In addition, the microelectromechanical microphone 502*b* can include an electro-acoustic sensor 512*b* configured to receive a pressure wave, and a voltage source device 510*b*. The microelectromechanical microphone 502*b* also can include an amplifier 514*b* that receives an output signal from the electro-acoustic sensor 512*b*. In accordance with aspects of this disclosure, the microelectromechanical microphone 502*b* includes a low-pass sigma-delta modulator 516*b* and a band-pass sigma-delta modulator 518*b*. A timing device 520*b* is coupled to such modulators and can provide a timing signal to each of the low-pass sigma-delta modulator 516*b* and the band-pass sigma-delta modulator 518*b*. The timing signal generated by the timing device 520*b* can be output to a frequency multiplier 524*b*. As an example, the frequency multiplier 524*a* is shown as an m=2 multiplier and can double the frequency of the timing signal output by the timing device 520*b*. In accordance with further aspects of this disclosure, the microelectromechanical microphone 502*b* can include a multiplexer device 522*b* that can generate a digital output signal as described herein in connection with FIG. 4, for example, or other embodiments of this disclosure.

Figure 5:
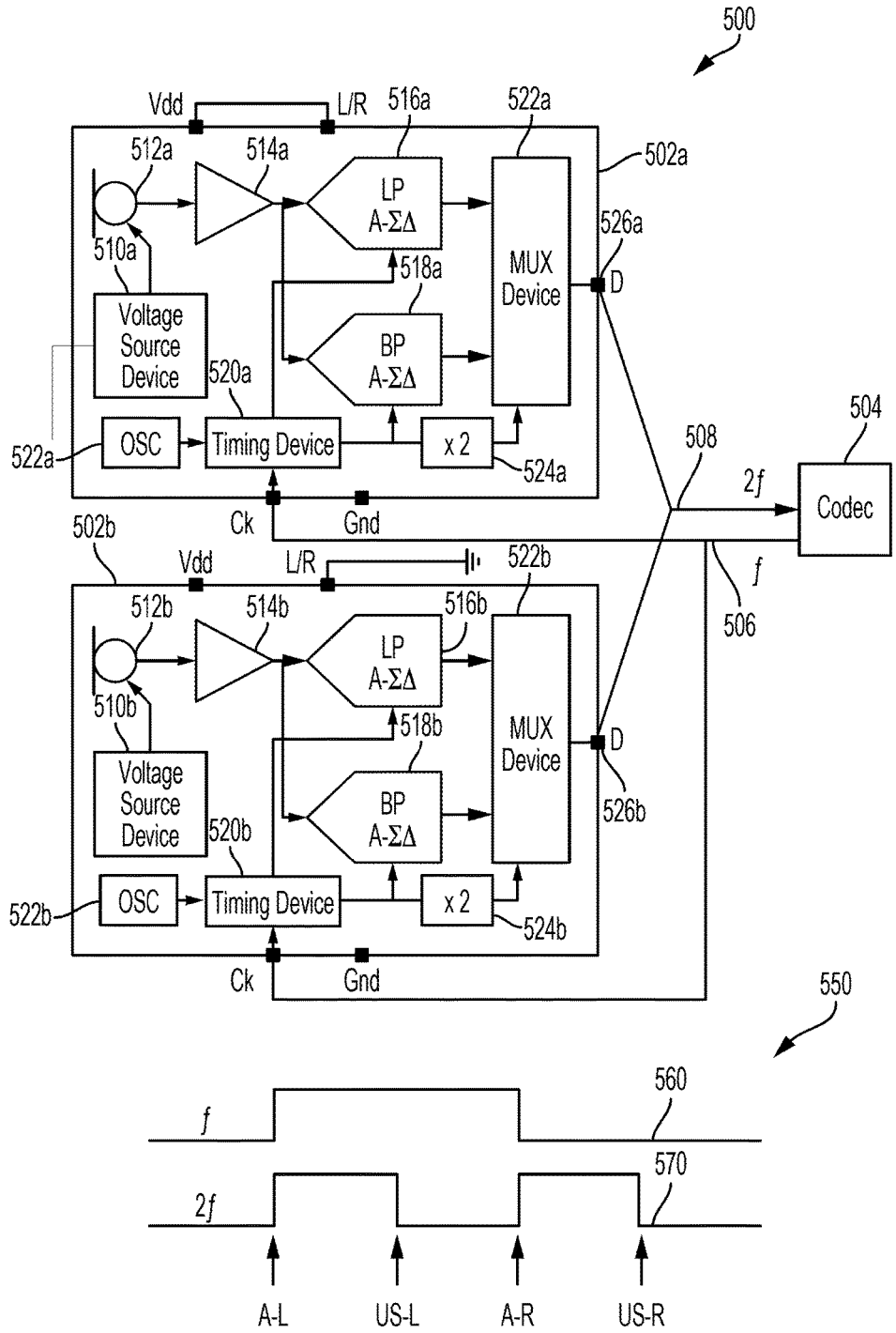
FIG. 5 presents an example of a system of microelectromechanical microphones and related clock signals in accordance with one or more embodiments of the disclosure.

Diagram 550 in FIG. 5 illustrates the four bits (represented as A-L, US-L, A-R, and US-R) that can be received at the codec device 502 via the data line 508. A square waveform 560 represents the clock signal having frequency f, and a square waveform 570 represents an output signal having a frequency 2*f* Therefore, in such implementations, the codec device can sample the incoming data stream at a frequency 2*f* (e.g., 4.8 MHz), corresponding to twice the clock frequency f that the codec device 504 provides to each of the L-channel microphone and R-channel microphone.

It should be appreciated that the stereophonic configuration illustrated in FIG. 5 can be backward-compatible with digital microeletromechanical microphones having only audio capabilities. For such microphones having an audio-only configuration, the codec device 504 can sample the data-stream output by the microphone at the same rate as the clock signal that the codec device 502 provides to the microphones (e.g., f=2.4 MHz). As such, the codec device 502 can collect audio samples from the microphones.

Figure 6:
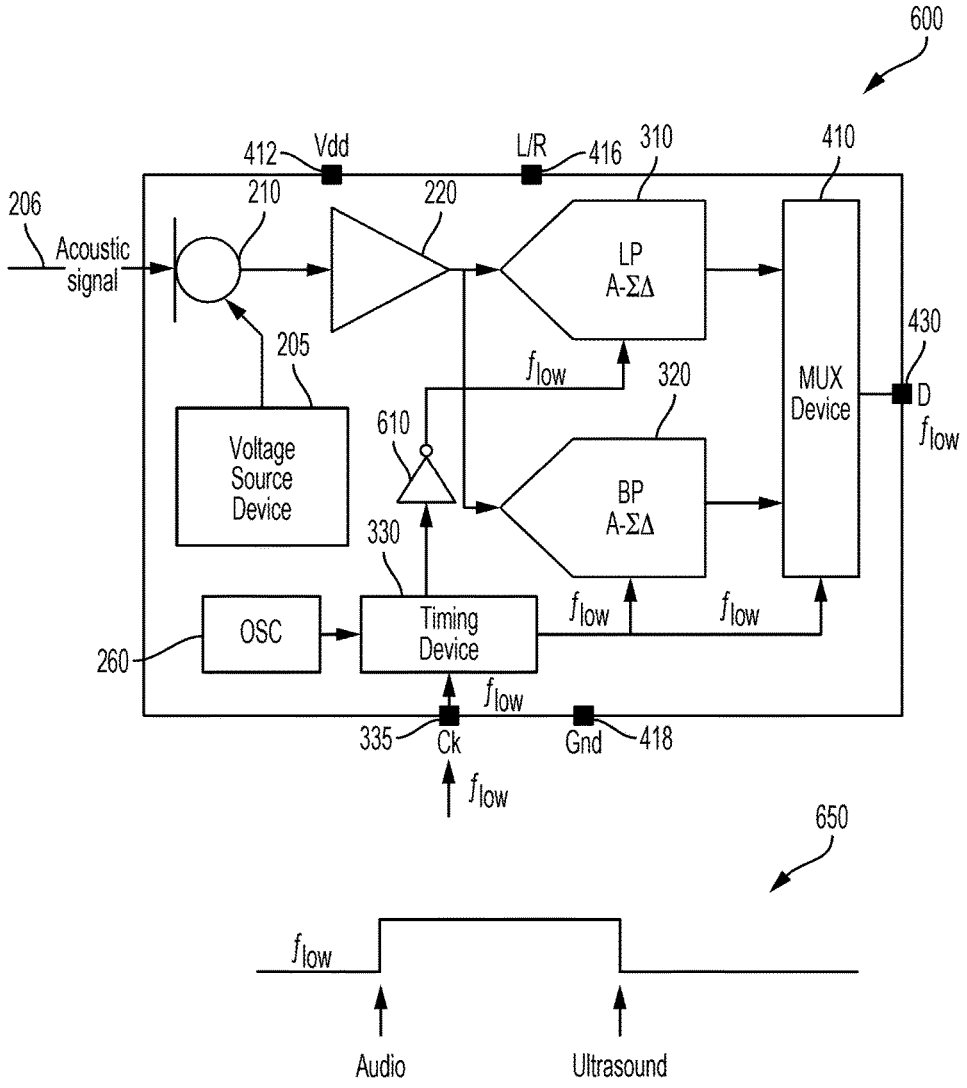
FIG. 6 presents an example of a microelectromechanical microphone and related clock signal in accordance with one or more embodiments of the disclosure.

As described herein, embodiments of this disclosure permit processing both audio and ultrasonic signals with a very small amount of power consumption, thus allowing for always-on mode of operation. In always-on mode, a microelectromechanical microphone in accordance with the disclosure can be operated at a clock frequency v that is lower than clock frequencies utilized in operation after a defined event (ultrasonic or otherwise) is detected. Such an event can cause wake-up of a host device, such as a codec device, after which wake-up high-frequency operation of the microelectromechanical microphone can be implemented. In one example, v can be equal to about 768 kHz. In another example, v can be equal to about 384 kHz. While selection of a value of the clock frequency v can be guided by processing capabilities of the host device, it should be appreciated that most any frequency can be utilized in this disclosure. FIG. 6 illustrates an example of a microelectromechanical microphone 600 that can operate in always-on mode. As illustrated, the output data-stream generated by the microelectromechanical microphone 600 can have the same frequency v as the clock frequency v (e.g., 768 kHz or 384 kHz) of the input clock signal. Further, the microelectromechanical microphone 600 can listen to or otherwise probe audio and ultrasonic signals. As shown in diagram 650 of FIG. 6, in always-on mode, the microelectromechanical microphone 600 can utilize or otherwise leverage opposite edges of the input clock signal in order to send multiplexed digital output signals for audio and ultrasound. To at least that end, the microelectromechanical microphone can include an inverter 610 that can ensure that a rising edge and a falling edge of the clock signal output from the timing device 330 are both utilized to generate a multiplexed digital output signal as described herein. While a specific arrangement of the inverter 610 is shown for illustration purposes, it should be appreciated that other arrangements also are contemplated in this disclosure. Specifically, in one embodiment, the inverter 610 can be integrated into the timing device 330. In another embodiment, the inverter 610 can be integrated into the low-pass sigma-delta modulator 310. In yet another embodiment, the inverter 610 can be integrated into the multiplexer device 410. It should further be appreciated that an inverter similar to the inverter 610 also can be utilized in other microelectromechanical microphones of the disclosure (e.g., microelectromechanical microphone 502*a* and microelectromechanical microphone 502*b*).

With respect to always-on mode, it should be appreciated that the microelectromechanical microphone 600 can be operated in monophonic operation when included in a stereophonic configuration such as the one described in connection with FIG. 5. It can be readily recognized that operation in monophonic mode can permit saving power.

Stereophonic configurations in accordance with this disclosure (see, e.g., FIG. 5) also can be implemented in low-power always-on mode. To that end, two microphones, each embodied in or including the microelectromechanical microphone 400, can be operated at a clock frequency lower than 2.4 MHz. In one example, the clock frequency f can be equal to about 768 kHz or about 384 kHz.

Figure 7:
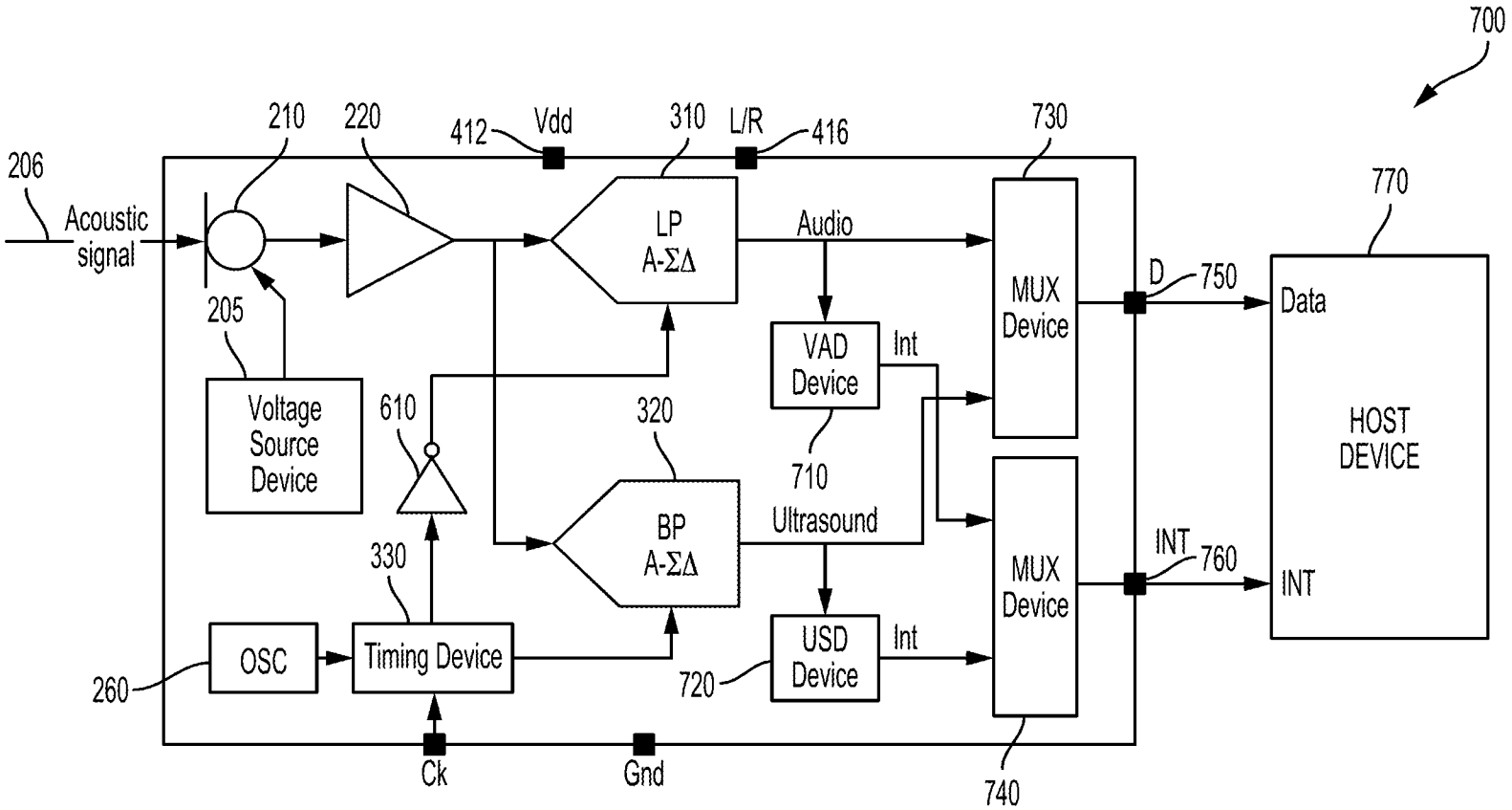
FIGS. 7-8 present examples of a system including a microelectromechanical microphone in accordance with one or more embodiments of the disclosure.

As described herein, a digital microelectromechanical microphone in accordance with this disclosure can monitor an environment for an event (ultrasonic or otherwise). Detection of the event can cause the digital microphone to instruct an external device to perform certain action, such as a wake-up process or other type of functionality (actuation of lights or other appliances; transmission of a communication, etc.). FIG. 7 illustrates an example of a digital microelectromechanical microphone 700 that can monitor an environment and can detect defined events in accordance with one or more embodiments of the disclosure. The digital microelectromechanical microphone 700 can be leveraged, for example, in low-power always-on mode of operation at a reduced input clock frequency, e.g., about 768 kHz or about 384 kHz. As illustrated, the digital microelectromechanical microphone 700 includes a voice activity detector (VAD) device 710 and an ultrasonic event detector (USD) device 720. The VAD device 710 can be referred to as an audible event detector device, and can process digital output signal generated by the low-pass sigma-delta modulator 310. As such, the VAD device 710 can be embodied in or can include a digital signal processor (DSP) or another type of processor that can apply detection logic configured to determine if a voice event has occurred. The voice event can be embodied in or can include, for example, presence or absence of an utterance in the acoustic signal 206; presence of a defined keyword (e.g., "lights" or "radio") or a defined phrase (e.g., "greetings, Omid"); presence of a defined feature and/or a defined pattern of features; a combination of the foregoing; or the like. In addition or in certain embodiments, the VAD device 710 can detect any type of defined audible events, such the start of vehicle engine or an appliance engine, and the like. In certain implementations, the VAD device 710 can apply Markov models in order to determine the presence of specific keywords or phrases, or specific audible sounds. Similarly, the USD device 720 can process digital output signal generated by the band-pass sigma-delta modulator 320. Thus, the USD device 720 can be embodied in or can include a digital signal processor (DSP) or another type of processor that can apply detection logic configured to determine if an ultrasonic event has occurred. Processors that can implement the functionality of the VAD device 710 and the USD 720 can include dedicated hardware, such as an application specific integrated circuit (ASIC), a field programmable gate array (FPGA), or the like.

In response to detection of a defined audible event and/or a defined ultrasonic event, the digital microelectromechanical microphone 700 can generate an interrupt signal that can be leverage to wake up a host device 770 (e.g., a codec device, sensor hub, an AP, or the like).

The digital microelectromechanical microphone 700 includes two multiplexers: A data multiplexer device 730 and a control multiplexer device 740. The data multiplexer device 730 can multiplex audio signals and ultrasonic signals generated, respectively, by the low-pass sigma-delta modulator 310 and the band-pass sigma-delta modulator 320. Thus, the multiplexing performed by the data multiplexer device 730 can result in multiplexed data signal, which can be referred to as data-stream signal. The data multiplexer device 730 can send the multiplexed data signal to host device 770 via a pin 750 functionally coupled to a communication line (e.g., a data line) of the host device 770. Other types of output interface besides a pin also can be utilized. Similarly, the control multiplexer device 740 can multiplex interrupt signals generated by the VAD device 710 and the USD device 720. The control multiplexer device 740 can send the multiplexed control signal to host device 770 via a pin 760 functionally coupled to another communication line (e.g., a control line) of the host device 770. Other types of output interface besides a pin also can be utilized. It should be appreciated that, as described herein, other arrangements of the inverter 610 can be implemented. For example, the inverter 610 can be integrated into the timing device 330. For another example, the inverter 610 can be integrated into the low-pass sigma-delta modulator 310. In yet another example, the inverter 610 can be integrated into the data multiplexer device 730 or the multiplexer device 740.

In certain embodiments, the microelectromechanical microphone 700 can include one or more storage devices (referred to as a buffer) in order to buffer audio signal while the VAD device 710 executes or otherwise implements a process to detect a voice event (e.g., presence of a keyword, a phrase, or other types of utterances). Information retained in the buffer can be sent to the host device 770 upon or after the host device is ready to receive data. The buffer can be embodied in or can include one or more first-in-first-out (FIFO) registers, one or more static random-access memories (SRAMs, a combination of the foregoing, or the like.

Figure 8:
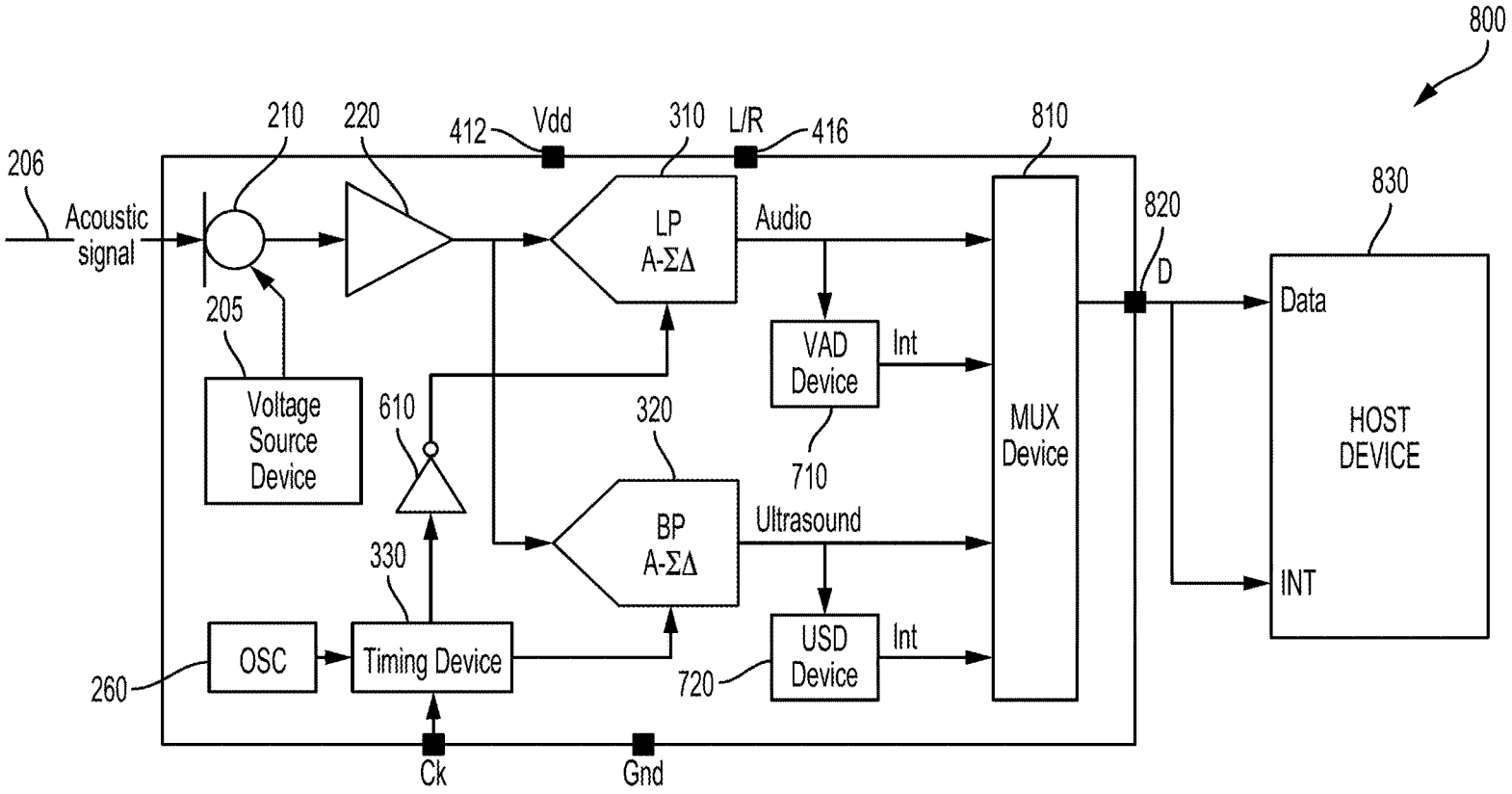

In certain embodiments, the complexity of the digital microelectromechanical microphone 700 can be reduced while maintaining substantially the same functionality. FIG. 8 illustrates an example of a digital microphone 800 that can operate in substantially the same manner as the digital microelectromechanical microphone 700. as illustrated, the digital microphone 800 includes a single multiplexer device 810 that can multiplex (i) digital output signals generated by the low-pass sigma-delta modulator 310 and the band-pass sigma-delta modulator 320, and (ii) interrupt signals generated by the VAD device 710 and the USD device 720. The multiplexer device 810 can send a data-stream formed from the multiplexed digital output signals and a control-stream formed from the multiplexed interrupt signals via a pin 820. The pin 820 can be connected to a data input line and a control input line of a host device 830. Therefore, the digital microphone 800 can have no more than five pins and can be compatible with legacy digital MEMS microphones that lack event detection functionality and/or low-power ultrasonic capability.

Figure 9:
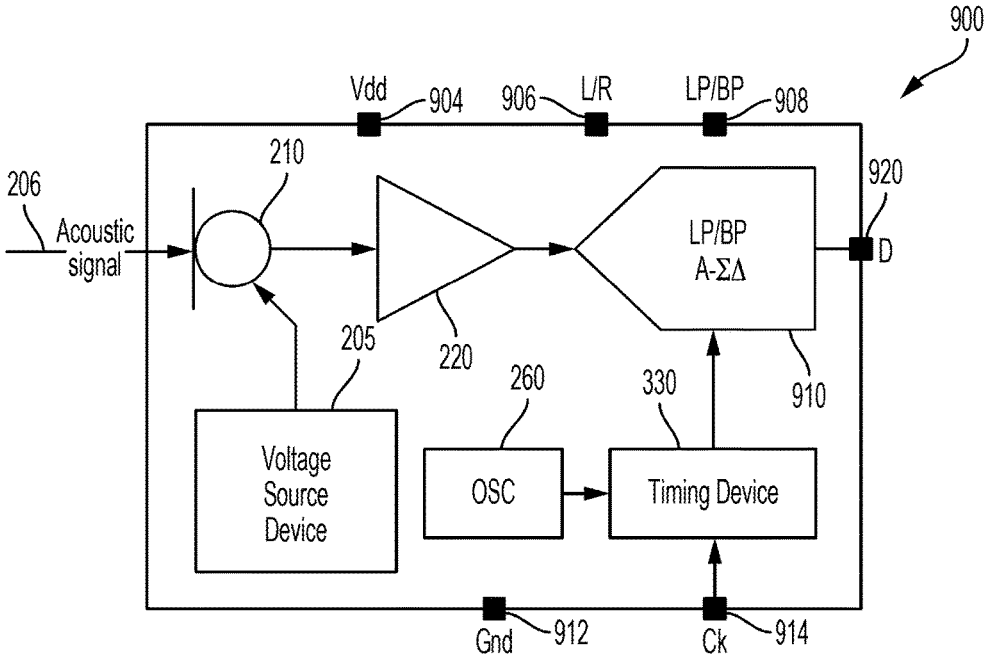
FIG. 9 and FIG. 10A present other examples of a microelectromechanical microphone in accordance with one or more embodiments of the disclosure.

In certain embodiments, microelectromechanical microphones in accordance with this disclosure can include a programmable component, which in certain implementations can improve operational flexibility. FIG. 9 illustrates an example of a digital microelectromechanical microphone 900 having programmable or otherwise re-configurable sigma-delta modulator in accordance with one or more embodiments of the disclosure. As illustrated, the digital microelectromechanical microphone 900 can include a programmable or otherwise configurable sigma-delta modulator 910 that can be reversibly configured to operate as a low-pass sigma-delta modulator or a band-pass sigma-delta modulator. As such, in one example, the same hardware can be configured to convert an audio signal or an ultrasonic signal to a digital output signal (such as a single-bit signal or multi-bit signal) using low-pass (LP) noise-shaping or band-pass (BP) noise shaping, respectively. Similar to other microelectromechanical microphones described herein, the microelectromechanical microphone 900 can include a pin 904 that can configure (e.g., receive or provide or otherwise supply) a defined voltage in the microelectromechanical microphone 900; an input pin 906 that in combination with 904 can configured the microelectromechanical microphone 900 as a R-channel microphone or an L-channel microphone. In addition, the microelectromechanical microphone can include a pin 912 that can permit setting a group voltage for the microelectromechanical microphone 900. Further, the microelectromechanical microphone 900 can include a pin 914 that can permit receiving a clock signal.

The LP/BP sigma-delta modulator 910 can output a digital output signal via a pin 920 or another type of output interface. The specific type of noise shaping—e.g., LP noise shaping or BP noise shaping—that can be implemented by the programmable sigma-delta modulator 910 can be configured in numerous ways. In one embodiment, an input pin 908 can receive information, such as an instruction or other type of programming input signal, indicative of a noise-shaping configuration. In another embodiment, the digital microelectromechanical microphone 900 can include an internal setting that can permit switching controllably between LP noise shaping and BP noise shaping. In certain implementations, the internal setting can be embodied in or can include information (e.g., data, metadata, and/or signaling) retained in a register or other type of or a non-volatile internal memory. In addition or in other implementations, the internal setting can be achieved via digital logic and/or analog switching elements (e.g., a MOSFET) that can suitably reconfigure the LP/BP sigma-delta modulator 910 from a first type of noise shaping to a second type of noise shaping, as illustrated in diagram 1050 of FIG. 10B. While a transition from low-pass noise shaping to band-pass noise shaping is illustrated in FIG. 10B, it should be appreciated that the disclosure is not limited in that respect. Further or in yet other implementations, the digital microelectromechanical microphone 900 can include a suitable interface (not depicted) that can permit receiving configuration instructions (e.g., programming input signals) that can specify the type of noise shaping to be implemented. Accordingly, the configuration instructions received via the interface can configure the configurable sigma-delta modulator to operate as a band-pass sigma-delta modulator or to operate as a low-pass sigma-delta modulator. Such an interface can be embodied in or can include a $I^2S$ control interface, a SoundWire interface, or power-line communication interface.

Figure 10A:
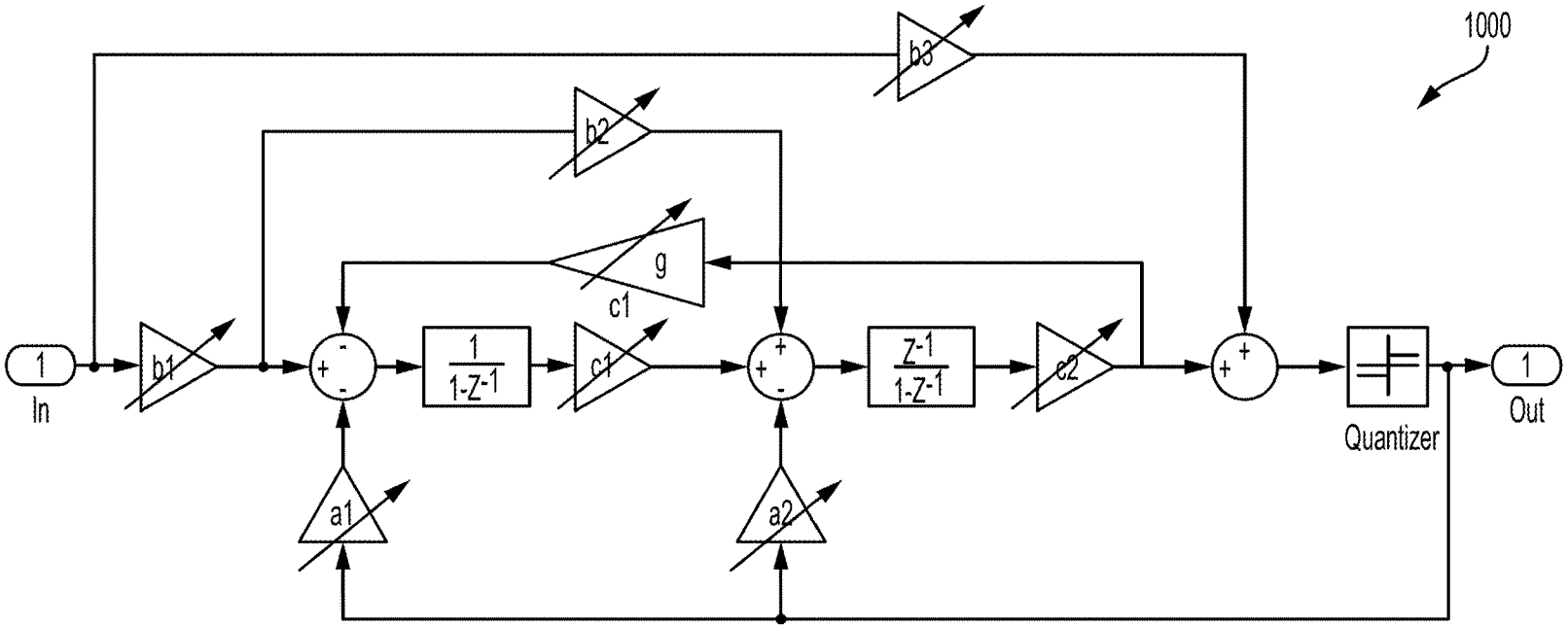
Figure 10B:
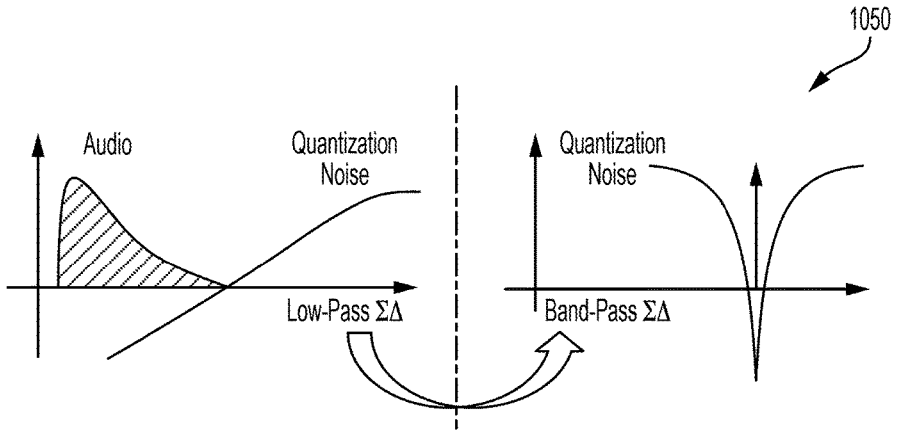
FIG. 10B illustrates the operation principle of the microelectromechanical microphone presented in FIG. 10A in accordance with one or more embodiments of the disclosure.

FIG. 10A illustrates an example of a sigma-delta modulator 1000 that can be reversibly configured as a low-pass sigma-delta modulator or a band-pass sigma-delta modulator based at least on certain coefficients associated with one or more components. The sigma-delta modulator 1000 can embody or can constitute the programmable sigma-delta modulator 910. Adjustments to at least one of the coefficients that define the transfer function of respective one or more elements in the sigma-delta modulator 1000 can permit adjustment of a center frequency and/or a frequency bandwidth in band-pass noise shaping. More specifically, the center frequency can be configured in numerous ways, including receiving configuration information (programming input signal) indicative of the center frequency via one or more pins; applying an internal setting retained in a register or in a non-volatile internal memory; receiving configuration information (e.g., programming input signal) indicative of the center frequency via a suitable interface, such as a $I^2S$ control interface, a SoundWire interface, or power-line communication interface. FIG. 10B depicts a transition from low-pass noise shaping to band-pass noise shaping in response to adjustments in coefficients of the sigma-delta modulator 1000.

Figure 11:
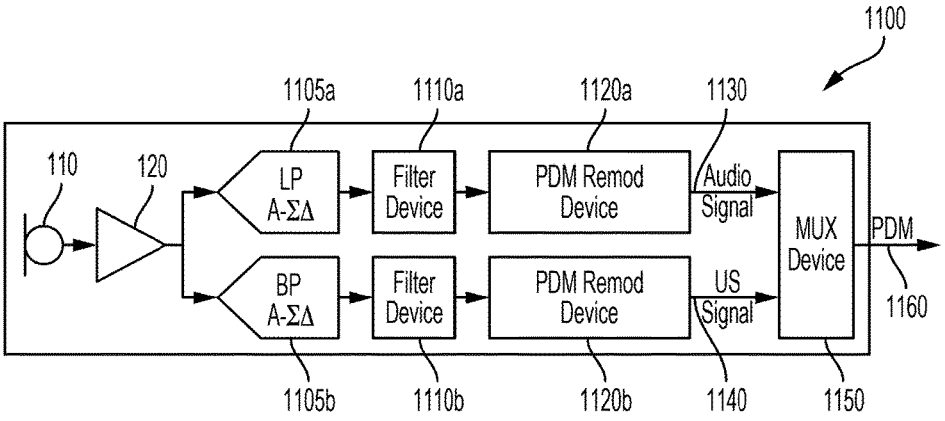
FIG. 11 presents another example of a microelectromechanical microphone and related clock signals in accordance with one or more embodiments of the disclosure.

While in certain embodiments of the disclosure the conversion from an analog signal representative of an acoustic signal received at a microelectromechanical microphone can be performed by a sigma-delta modulator, it should be appreciated that the disclosure is not limited in this respect and A/D conversion and/or encoding can include and/or can be performed by other components. As an illustration, FIG. 11 presents an example of a digital microelectromechanical microphone 1100 in accordance with one or more embodiments of the disclosure. The digital microelectromechanical microphone 1100 can utilize or otherwise leverage an analog low-pass sigma-delta modulator 1105*a* and an analog band-pass sigma-delta modulator 1105*b* to perform noise shaping on an analog signal generated by the amplifier 120. Each of such sigma-delta modulators can output an analog signal that can be processed by a digital filter and a digital PDM modulator in order to generate a digital output signal. More specifically, in certain implementations, the analog signal generated by both or either of the analog low-pass sigma-delta modulator 1105*a* or the analog band-pass sigma-delta modulator 1105*b* can be multi-bit and/or its sample rate can be different than a desired or otherwise intended output sample rate. Therefore, in one example, a digital filter device 1110*a* can receive an analog output signal (such an electric output signal) from the analog low-pass sigma-delta modulator 1105*a*, and can generate a first digital output signal that can be input into a digital PDM modulator 1120*a*. The digital PDM modulator 1120*a* can receive the first digital output signal and can generate a first single-bit PDM signal 1130. In addition, a digital filter device 1110*b* can receive an analog output signal (such as an electric output signal) from the analog band-pass sigma-delta modulator 1105*b*, and can generate a second digital output signal that can be input into a digital PDM modulator 1120*b*. The digital PDM modulator 1120*b* can receive the second digital output signal and can generate a second single-bit PDM signal 1140. The first and second single-bit PDM signals can be multiplexed at a defined output frequency by a multiplexer device 1150, resulting in a PDM output signal 1160. The digital filter device 1110*a* can include or can implement, for example, a Chebyshev filter, a Butterworth filter, an elliptical filter, a multi-rate finite impulse response (FIR) filter, or an infinite impulse response (IIR) filter, or the like. Similarly, the digital filter device 1110*b* can include or can implement, for example, a Chebyshev filter, a Butterworth filter, an elliptical filter, a multi-rate FIR filter, or an IIR filter, or the like. The foregoing examples of filters and other similar examples are provided for the sake of illustrations, and it should be appreciated that the disclosure is not limited in this respect.

In certain embodiments, the microelectromechanical microphone 1100 can include one or more components for automatic gain control, offset cancellation, frequency equalization, and/or non-linearity cancellation. In a scenario in which one of the analog low-pass sigma-delta modulator 1105*a* or the analog band-pass sigma-delta modulator 1105*b* can be configured to generate directly PDM output as intended, only one of the signal paths (either audio or ultrasonic) can require additional processing for generation of the PDM output signal 1160. For example, U.S. patent application Ser. No. 14/719,507, filed on May 22, 2015 and assigned to the Assignee of the present disclosure, discloses various example of the additional processing that may be implemented for generation of the PDM output signal 1160. The contents of such patent application are hereby incorporated by reference herein in their entirety.

As described herein, a microelectromechanical microphone of the disclosure can include circuitry to generate a digital output signal (including separate audio signal and ultrasonic signal, for example) according to a format suitable for a digital signal, such as $I^2S$ format, TDM, format, SoundWire format, or SlimBus format. Such audio and ultrasonic signals can be time-multiplexed in the microelectromechanical microphone using one of such protocols, and subsequently demultiplexed by a host device in order to generate an audio bit-stream and an ultrasonic bit-stream.

Figure 12:
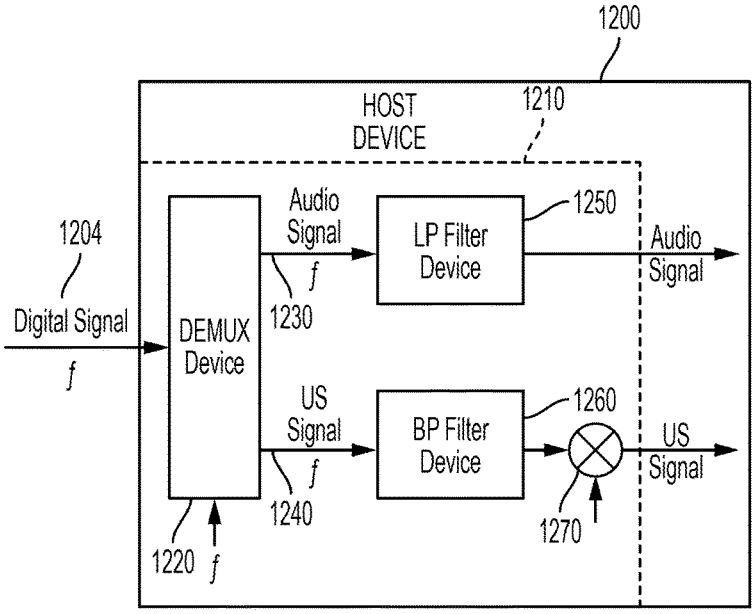
FIGS. 12-13 present example of devices in accordance with one or more embodiments of the disclosure.

FIG. 12 illustrates an example of an input stage 1210 of a host device 1200 (e.g., a codec device, a sensor hub, an AP, or the like) in accordance with one or more embodiments of the disclosure. The host device 1200 can receive a time-multiplexed digital signal 1204 generated, for example, in a single-microphone configuration. The time-multiplexed digital signal 1204 can be generated based on a frequency f suitable for low-power always-on operation, and can be embodied in or can include an input data-stream. In one example, the time-multiplexed digital signal 1204 can be generated at f=768 kHz or f=384 kHz and can be formatted using PDM format. As such, the time-multiplexed digital signal 1204 represents an input data-stream. It should be appreciated that, in certain embodiments, the time-multiplexed digital signal 1204 can be generated by a microelectromechanical microphone in accordance with aspects of this disclosure. As illustrated, the time-multiplexed digital signal 1204 can be received at the input stage 1210 of the host device 1200. Specifically, the time-multiplexed digital signal 1204 can be received at a demultiplexer device 1220. In one example, the time-multiplexed digital signal 1204 can embody or can constitute an input data-stream. The demultiplexer device 1220 can separate the time-multiplexed digital signal 1204 (e.g., the input data-stream) into an audio bit-stream 1230 (labeled as "audio signal") and an ultrasonic bit-stream 1240 (labeled as "US signal"). As such, two signal processing paths can be implemented—an audio processing path for the audio bit-stream and an ultrasonic processing path for the ultrasonic bit-stream. Each of the first processing path and second processing path can include appropriate filtering, such as low-pass filtering for the audio bit-stream 1230 and band-pass filtering for the ultrasonic bit-stream 1240. As such, the input stage 1210 of the host device 1200 can include a low-pass filter device 1250 that can process the audio bit-stream 1230, and a band-pass filter device 1260 that can process the ultrasonic bit-stream 1240. In addition or in other embodiments, the ultrasonic path can include a mixer device 1270 to down-convert the ultrasonic signal to a baseband frequency. It should be appreciated that, as any of the examples described herein, the input stage 1210 of the host device 1200 is presented for the sake of illustration, and other embodiments are contemplated in this disclosure. For instance, other than inclusion of the demultiplexer device 1220, various arrangements of low-pass filtering, band-pass filtering, demodulation, a combination thereof, or the like, can vary according to specific implementation of the host device 1210. Similar to other embodiments of the disclosure, the LP filter device 1250 can include or can implement, for example, a Chebyshev filter, a Butterworth filter, an elliptical filter, a multi-rate FIR filter, a multi-rate IIR filter, or the like. In addition, the BP filter device 1260 can include or can implement, for example, a Chebyshev filter, a Butterworth filter, an elliptical filter, a multi-rate FIR filter, a multi-rate IIR filter, or the like. It should be appreciated that the disclosure is not limited with respect to the specific filter implemented by a filter device in the input stage 1210 of the host device 1210, and other digital filters can be implemented.

The audio signal that is output from the LP filter device 1250 is internal to the host device 1200 and can be sent to other portions thereof (components, processors, sensors, devices, etc.) for further processing by the host device 1200. The US signal output from the mixer device 1270 also is internal to the host device 1200 and can be sent to other portions thereof (components, processors, sensors, devices, etc.) for further processing by the host device 1200.

Figure 13:
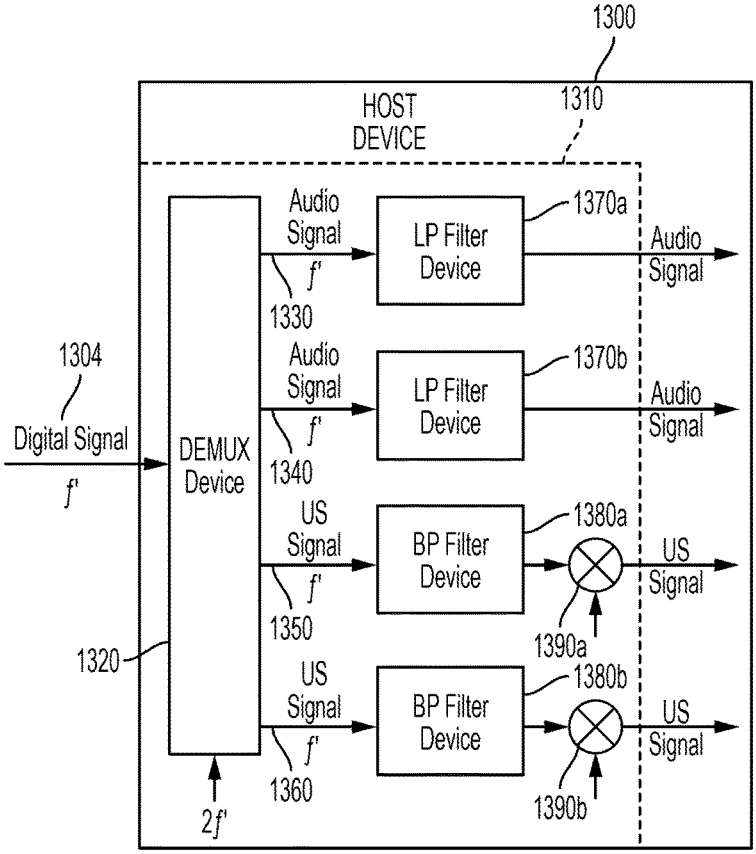

As described herein, two microelectromechanical microphones in accordance with this disclosure can generate a digital output signal in a stereophonic configuration. FIG. 13 illustrates an example of an input stage 1310 of a host device 1300 (e.g., a codec device, a sensor hub, an AP, or the like) in accordance with one or more embodiments of the disclosure. The host device 1300 can receive a time-multiplexed digital signal 1304 generated, for example, in a two-microphone, stereophonic configuration. The time-multiplexed digital signal 1304 can be generated based on a frequency f suitable for low-power always-on operation, and can be embodied in or can include an input data-stream. In one example, the time-multiplexed digital signal 1304 can be generated at f=2.4 MHz and can be formatted using PDM format. As illustrated, the time-multiplexed digital signal 1304 can be received at the input stage 1310 of the host device 1300. Specifically, the time-multiplexed digital signal 1304 can be received at a demultiplexer device 1320. In one example, the time-multiplexed digital signal 1304 can be formatted according to PDM format. The demultiplexer device 1320 can separate the time-multiplexed digital signal 1304 into a first audio bit-stream 1330 (labeled "audio signal") originated from a first microelectromechanical microphone (e.g., an L-channel microphone; see FIG. 5) and a second audio bit-stream 1340 (labeled as "audio signal") originated from a second microelectromechanical microphone (e.g., an R-channel microphone; see FIG. 5). The demultiplexer device 1320 also can separate the time-multiplexed digital signal 1304 into a first ultrasonic bit-stream 1350 (labeled "US signal") that is originated from the first microelectromechanical microphone, and a second ultrasonic bit-stream 1360 (labeled "US signal") that is originated from the second microelectromechanical microphone. As such, four signal processing paths can be implemented—two audio processing paths for the audio bit-streams 1330 and 1340, and two ultrasonic processing paths for the ultrasonic bit-streams 1350 and 1360. Each of the processing paths can include appropriate filtering, such as low-pass filtering for the audio bit-streams 1330 and 1340 and band-pass filtering for the ultrasonic bit-streams 1350 and 1360. More specifically, an LP filter device 1370*a* can receive the audio bit-stream 1330, and an LP filter device 1370*b* can receive the audio bit-stream 1340. Similarly, a BP filter device 1380*a* can receive the ultrasonic bit-stream 1350, and a BP filter device 1380*b* can receive the ultrasonic bit-stream 1360. The LP filter device 1370*a* or the LP filter device 1370*b*, or both, can include or can implement, for example, a Chebyshev filter, a Butterworth filter, an elliptical filter, a multi-rate FIR filter, a multi-rate IIR filter, or the like. In addition, the BP filter device 1380*a* or the BP filter device 1380*b*, or both, can include or can implement, for example, a Chebyshev filter, a Butterworth filter, an elliptical filter, a multi-rate FIR filter, a multi-rate IIR filter, or the like. It should be appreciated that the disclosure is not limited with respect to the specific filter implemented by a filter device in the input stage 1310 of the host device 1300, and other digital filters can be implemented.

In addition or in other embodiments, the ultrasonic path can additionally include one or more mixer devices to down-convert the ultrasonic signal to a baseband frequency. As illustrated in the example input stage 1310 of the host device 1310, a mixer device 1390*a* can receive a digital output signal from the BP filter device 1380*a* and can mix it with a reference signal at the baseband frequency, resulting in a digital signal that is internal to the host device 1300 and can be output to other portions thereof (components, processors, sensors, devices, etc.) for further processing by the host device 1300. In addition, a mixer device 1390*b* can receive a digital output signal from the BP filter device 1380*b* and can mix it with another reference signal at the baseband frequency, resulting in another digital signal that also is internal to the host device 1300 and can be output to other portions thereof (components, processors, sensors, devices, etc.) for further processing by the host device 1300.

Figure 14:
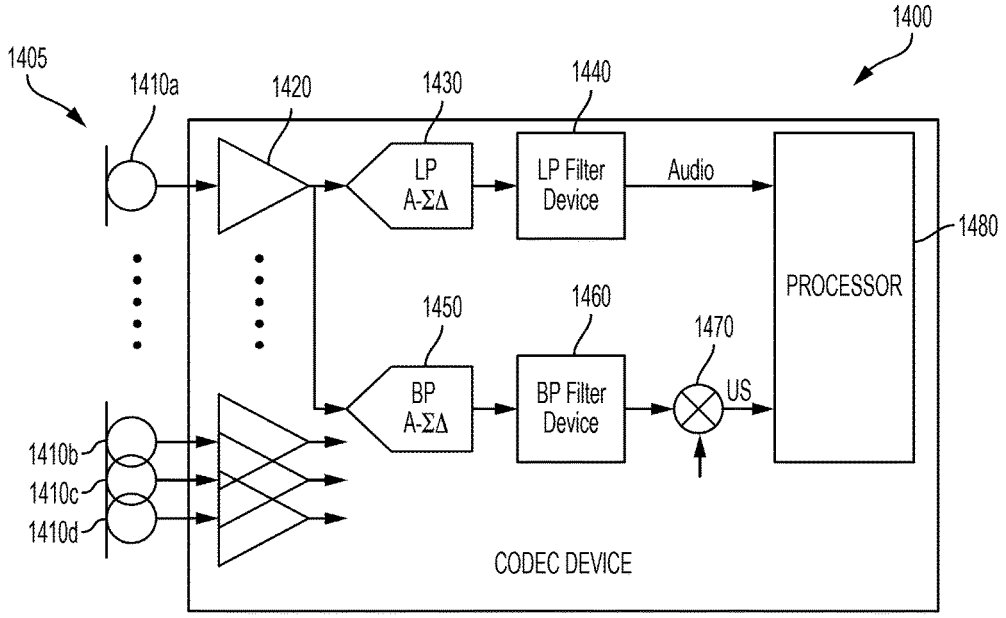
FIG. 14 presents another example of a system including a microelectromechanical microphone in accordance with one or more embodiments of the disclosure.

Conventional audio codec devices can include only low-pass analog-to-digital converters in order to process audio, or audio and ultrasonic signals. FIG. 14 illustrates an example of an audio codec device 1400 in accordance with one or more embodiments of the disclosure. As illustrated, the audio codec device 1400 is functionally coupled to (or can include) a group 1405 of electro-acoustic sensors, which is exemplified with electro-acoustic sensors 1410*a*-1410*d*. An amplifier 1420 can receive an output signal from the electro-acoustic sensor 1410*a* and can send a second output signal to a low-pass sigma-delta modulator 1430 and a band-pass sigma-delta modulator 1450. A digital output of a low-pass sigma-delta modulator 1430 can be coupled to a low-pass filter device 1440 which can generate a first digital output signal representative of an audio signal present in an acoustic signal that can be received at the electro-acoustic sensor 1410*a*. In addition, the digital output of a band-pass sigma-delta modulator 1450 can be coupled to a band-pass filter device 1460. The LP filter device 1440 can include or can implement, for example, a Chebyshev filter, a Butterworth filter, an elliptical filter, a multi-rate FIR filter, a multi-rate IIR filter, or the like. In addition, the BP filter device 1460 can include or can implement, for example, a Chebyshev filter, a Butterworth filter, an elliptical filter, a multi-rate FIR filter, a multi-rate IIR filter, or the like. It should be appreciated that the disclosure is not limited with respect to the specific filter implemented by a filter device in the audio codec device 1400, and other digital filters can be implemented.

A digital output of the band-pass filter device 1460 can be input into a mixer device 1470, resulting in a second digital output signal representative of an ultrasonic signal present in the acoustic signal. The first digital output signal and the second digital output signal also can be processed at a processor 1480 (e.g., a DSP or other types of dedicated hardware) utilizing digital signal processing techniques, for example. It should be appreciated that, in certain embodiments, the codec device 1400 also can include additional components as part of the audio path and/or the ultrasonic path, for DC offset cancellation, automatic gain control, noise gating, and the like. In addition or in other embodiments, the codec device 1400 also can include additional circuitry and/or control components in order to reconfigure each of the audio path and the ultrasonic path independently, turn them on or off, or change the center frequency of the band-pass sigma-delta modulator 1450 and the center frequency and characteristics of the band-pass filter device 1460.

While not illustrated, it is to be appreciated that the output of each of the amplifiers respectively coupled to each of the electro-acoustic sensors 1410*b*, 1410*c*, 1410*c* and other electro-acoustic sensors in the group 1405 can be processed by components similar to those illustrated and discussed herein in connection with the output of the amplifier 1420.

Figure 15:
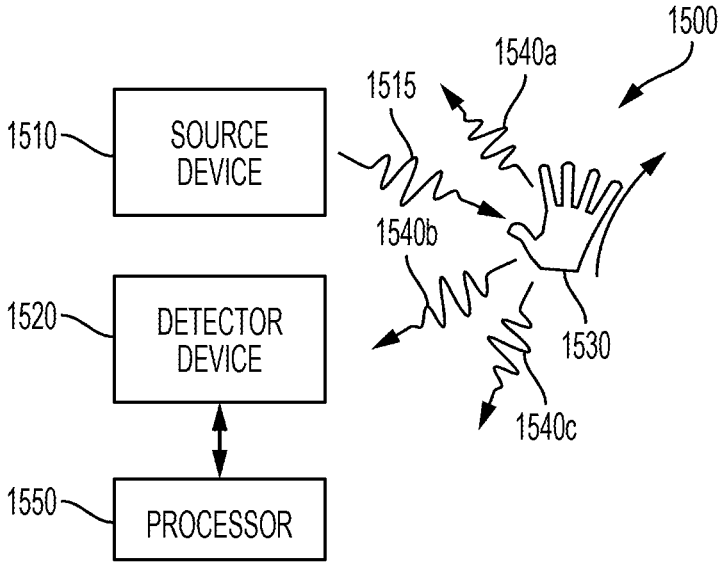
FIGS. 15-17 present examples of detection systems including a microelectromechanical microphone in accordance with one or more embodiments of the disclosure.
Figure 16:
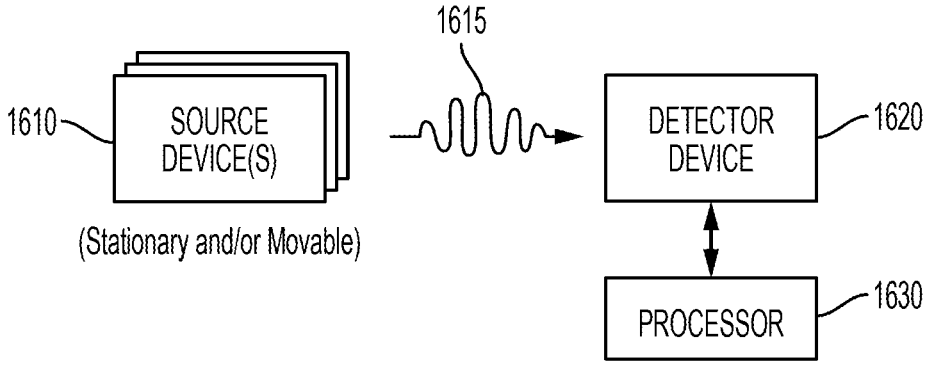

FIGS. 15-16 illustrate examples of detection systems that can include a microelectromechanical microphone in accordance with one or more aspects of the disclosure. Example detection system 1500 shown in FIG. 15 can include a source device 1510 that can emit an ultrasonic signal 1515. The ultrasonic signal 1515 can be emitted isotropically or directionally (relying on beam-forming techniques, for example). In certain implementations, the ultrasonic signal 1515 can impinge on a movable object 1530 and can reflect off a surface of the movable object 1530, resulting in reflected ultrasonic signals 1540*a*-1540*c*. While the movable object 1530 is represented as a hand, the disclosure is not so limited and any movable object (e.g., a wand of a gaming console) can embody or can constitute the movable object 1530.

As illustrated, a detector device 1520 can receive at least a portion of the ultrasonic signals 1540*a*-1540*c* via a microelectromechanical microphone in accordance with this disclosure. The microelectromechanical microphone can be arranged in a single-microphone configuration or in a stereophonic configuration (see, e.g., FIG. 5). The microelectromechanical microphone can include an event detector device (e.g., ED device 250 or USD device 720) that can be configured to determine if an ultrasonic event has occurred. The event detector device (not shown in FIG. 15) can operate in accordance with aspects described herein. As such, in response to detecting at least the portion of the reflected ultrasonic signals 1540*a*-1540*c*, the detector device 1520 can generate an interrupt signal, and can send such a signal to a processor 1550 or other type of host device (e.g., host device 770 or host device 830). In certain embodiments, the interrupt signal can represent detection of a gesture associated with the movable object 1530. In a scenario in which the detector device 1520 and/or the processor 1550 are integrated into or otherwise functionally coupled to a gaming console, the interrupt signal can represent movement of a game player's hand or an electronic-wand operated by the game player. In other embodiments, the detector device 1520 and/or the processor 1550 can constitute a wearable device (e.g., a headset, a headphone, or another type of hearing aids; smartglasses; a head-mounted visor; a helmet; or the like). As such, an interrupt signal generated by the detector device 1529 can represent a gesture of an end-user, where the gesture can be intended for actuation of a specific functionality of the wearable device—e.g., reception of voice call in a mobile phone, initiation of a chronograph in a sports watch, and the like. In addition or in yet other embodiments, such as the embodiment shown in FIG. 17, the processor 1550 can constitute a sensor hub.

The processor 1550 can receive the interrupt signal and can apply logic configured to supply an alarm or trigger other type of responses, such as implementing motion sensing, noise cancellation, or beamforming; and/or executing certain module(s) within a wearable device that includes the processor 1550. In certain implementations, the alarm can be an audible or ultrasonic alarm, a haptic alarm, and/or a visual alarm.

In the detection system 1600 shown in FIG. 16, one or more source devices 1610 can emit (isotropically or directionally) an ultrasonic signal 1615. In certain implementations, at least one of the source device(s) 1610 can be embodied in or can include an ultrasonic source mounted or otherwise integrated into a vehicle. In one example, the ultrasonic signal 1615 can be modulated and/or encoded to convey one or more characteristics of the vehicle, such as vehicle identification number (VIN), vehicle's speed and/or acceleration, identity of an operator of the vehicle, a combination thereof, or the like. A detector device 1620 can receive at least a portion of the ultrasonic signal 1615 via a microelectromechanical microphone in accordance with this disclosure. The microelectromechanical microphone can be arranged in a single-microphone configuration or in a stereophonic configuration. The microelectromechanical microphone can include an event detector device (e.g., ED device 250 or USD device 720) that can be configured to determine if an ultrasonic event has occurred. The event detector device (not shown in FIG. 16) can operate in accordance with aspects described herein. As such, in response to detecting at least the portion of the ultrasonic signal 1615, the detector device 1620 can generate an interrupt signal, and can send such a signal to a processor 1630 or other type of host device (e.g., host device 770 or host device 830). In certain embodiments, the detector device 1520 and/or the processor 1550 can constitute a wearable device, such as a headset, a headphone, or another type of hearing aids; smartglasses; a head-mounted visor; a helmet; or the like. In addition or in other embodiments, such as the embodiment shown in FIG. 17, the processor 1630 can constitute a sensor hub.

Figure 17:
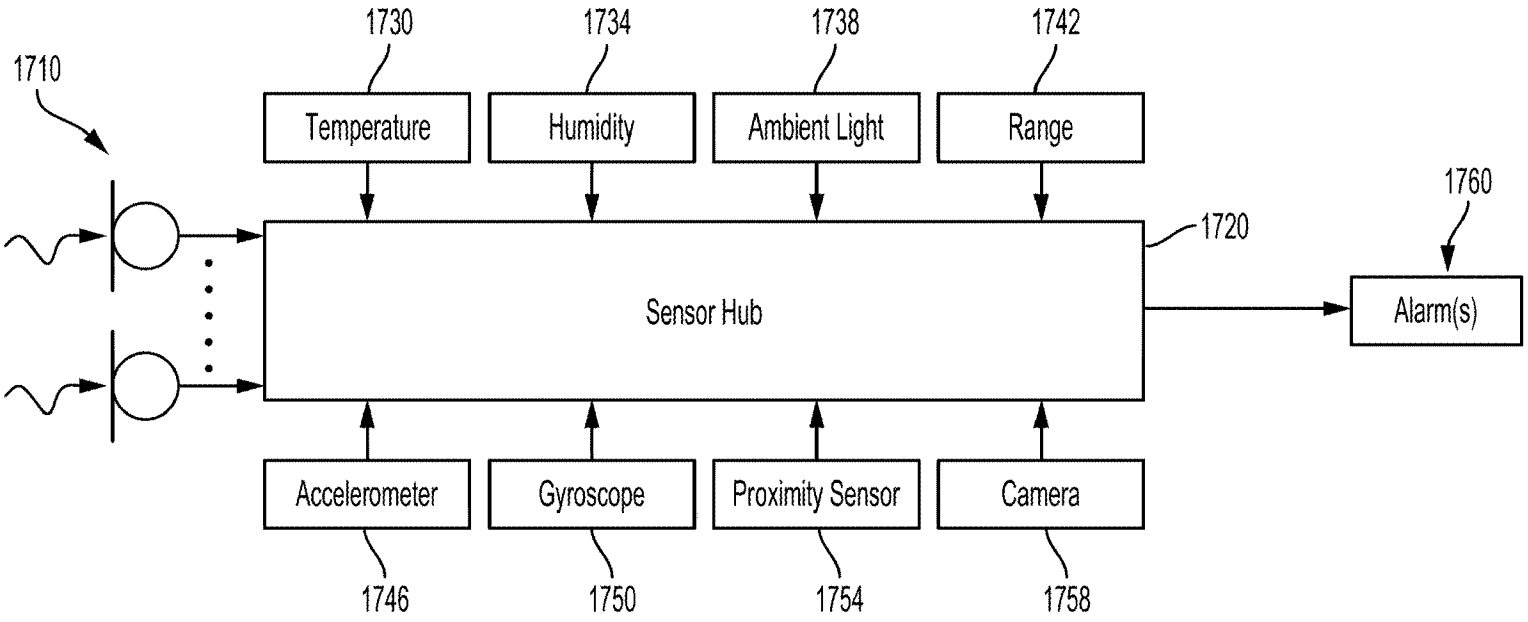

The example sensor hub 1720 illustrated in FIG. 17 can include electro-acoustic sensors 1710 that can receive a acoustic wave, including an audible signal and/or an ultrasonic signal. At least one of the electro-acoustic sensors 1710 can be functionally coupled to circuitry for generation of digital output signal in accordance with this disclosure. The circuitry also can include the processor 1550 or the processor 1630. The sensor hub 1720 also can receive information (in digital signal and/or analog signal) from sensors or other type of transducers. Specifically, the sensor hub can receive information from one or more of a temperature sensor 1730, a humidity sensor 1734, an ambient light sensor 1738 (or another type of photodetector), a range measurement device 1742, an accelerometer 1746 (which can probe linear acceleration, for example), a gyroscope 1750 (which can probe angular acceleration and/or orientation of a device), a proximity sensor 1754, or a camera 1758. In certain embodiments, each of the sensors can be implemented in a dedicated die. In other embodiments, two or more of the sensors can be implemented in a common die.

As illustrated, the sensor hub 1720 can be configured to execute or otherwise implement logic configured to supply one or more alarms 1760 or to trigger other type of responses, such as implementing motion sensing, noise cancellation, or beamforming; and/or executing certain module(s) within a wearable device or another type of device integrated or functionally coupled to the sensor hub 1720. In certain implementations, at least one of the alarm(s) 1760 can be an audible or ultrasonic alarm, a haptic alarm, and/or a visual alarm.

In certain implementations, the sensor hub 1720 can be integrated into or can be functionally coupled to an infotainment system or another type of vehicular electronics in a vehicle. As such, in one example, the sensor hub 1720 can leverage the detector device 1620 to determine the presence of another vehicle by detecting ultrasonic signals in accordance with this disclosure. In other implementations, the sensor hub 1720 can be included in a mobile device.

As employed herein, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in this specification and annexed drawings should generally be construed to mean "one or more" unless specified otherwise or clear from context to be directed to a singular form.

In addition, the term "processor" can refer to substantially any computing processing unit or device including, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an ASIC, a DSP, a FPGA, a programmable logic controller (PLC), a complex programmable logic device (CPLD), a discrete gate or transistor logic, discrete hardware components or any combination thereof designed to perform the functions described herein. Processors can exploit nano-scale architectures such as, but not limited to, molecular and quantum-dot based transistors, switches and gates, in order to optimize space usage or enhance performance of mobile device equipment. A processor can also be implemented as a combination of computing processing units.

Memory disclosed herein can include volatile memory or nonvolatile memory or can include both volatile and nonvolatile memory. By way of illustration, and not limitation, nonvolatile memory can include ROM, programmable ROM (PROM), electrically programmable ROM (EPROM), electrically erasable PROM (EEPROM) or flash memory. Volatile memory can include RAM, which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). The memory (e.g., data storages, databases) of the embodiments is intended to include, without being limited to, these and any other suitable types of memory.

As used herein, terms such as "data storage," "database," and substantially any other information storage component relevant to operation and functionality of a component, refer to "memory components," or entities embodied in a "memory" or components including the memory. It will be appreciated that the memory components or computer-readable storage media, described herein can be either volatile memory or nonvolatile memory or can include both volatile and nonvolatile memory.

In addition, the terms "example" and "such as" are utilized herein to mean serving as an instance or illustration. Any embodiment or design described herein as an "example" or referred to in connection with a "such as" clause is not necessarily to be construed as preferred or advantageous over other embodiments or designs. Rather, use of the terms "example" or "such as" is intended to present concepts in a concrete fashion. The terms "first," "second," "third," and so forth, as used in the claims and description, unless otherwise clear by context, is for clarity only and does not necessarily indicate or imply any order in time.

What has been described above includes examples of one or more embodiments of the disclosure. It is, of course, not possible to describe every conceivable combination of components or methodologies for purposes of describing these examples, and it can be recognized that many further combinations and permutations of the present embodiments are possible. Accordingly, the embodiments disclosed and/or claimed herein are intended to embrace all such alterations, modifications and variations that fall within the spirit and scope of the detailed description and the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A microelectromechanical microphone, comprising:

an electro-acoustic sensor that receives an acoustic signal including an ultrasonic signal and generates a first electric output signal representative of the acoustic signal;

an amplifier that generates a second electric output signal based at least on the first electric output signal;

a band-pass sigma-delta modulator that receives the second electric output signal and generates a first digital output signal representative of the ultrasonic signal based at least on the second electric output signal; and a low-pass sigma-delta modulator that generates a second digital output signal representative of an audible signal based at least on the second electric output signal, wherein the first digital output signal and the second digital output signal are output simultaneously.

2. The microelectromechanical microphone of claim 1, further comprising an interface configured to receive a programming input signal to configure operation of the band-pass sigma-delta modulator.

3. The microelectromechanical microphone of claim 2, wherein the programming input signal configures a center frequency of the band-pass sigma-delta modulator.

4. The microelectromechanical microphone of claim 1, further comprising an event detector device configured to determine that an ultrasonic event occurred, and further configured to generate an interrupt signal in response to the ultrasonic event.

5. The microelectromechanical microphone of claim 1, the acoustic signal further comprising the audible signal, wherein the amplifier generates a third electric output signal.

6. The microelectromechanical microphone of claim 5, wherein the first digital output signal is formatted according to one of pulse density modulation (PDM) format, inter-IC sound ($I^2S$)controller format, time division multiplexing (TDM) format, or SoundWire format, and wherein the second digital output signal is formatted according to one of pulse density modulation (PDM) format, $I^2S$ controller format, TDM format, SoundWire format, or SlimBus.

7. The microelectromechanical microphone of claim 5, further comprising an interface configured to receive a programming input signal to configure operation of the low-pass sigma-delta modulator.

8. The microelectromechanical microphone of claim 7, wherein each of the band-pass sigma-delta modulator and the low-pass sigma-delta modulator receives a clock signal for analog-to-digital conversion, and wherein the microelectromechanical microphone further comprises a multiplexer device that time-multiplexes the digital output signal representative of the ultrasonic signal and the digital output signal representative of the audible signal, the multiplexer device generates a first bit at a first edge of the clock signal and a second bit at second edge of the clock signal opposite to the first edge, the first corresponds to the digital output signal representative of the audible signal, and the second bit corresponds to the digital output signal representative of the ultrasonic signal.

9. The microelectromechanical microphone of claim 7, wherein each of the band-pass sigma-delta modulator and the low-pass sigma-delta modulator receives a clock signal for analog-to-digital conversion, and wherein the microelectromechanical microphone further comprises a multiplexer device that time-multiplexes the digital output signal representative of the ultrasonic signal and the digital output signal representative of the audible signal, the multiplexer device generates a first bit at a first edge of the clock signal and a second bit at second edge of the clock signal opposite to the first edge, the first bit corresponds to the digital output signal representative of the ultrasonic signal, and the second bit corresponds to the digital output signal representative of the audible signal.

10. The microelectromechanical microphone of claim 7, further comprising:

a frequency multiplier device that doubles a frequency of a clock signal resulting in a timing signal having a doubled frequency relative to the clock signal, wherein each of the band-pass sigma-delta modulator and the low-pass sigma-delta modulator receives the clock signal for analog-to-digital conversion; and a multiplexer device that multiplexes, using the timing signal, the digital output signal representative of the ultrasonic signal and the digital output signal representative of the audible signal.

11. The microelectromechanical microphone of claim 9, wherein the multiplexer device outputs a bit stream including a first bit stream corresponding to the digital output signal representative of the ultrasonic signal, and a second bit stream corresponding to the digital output signal representative of the audible signal.

12. The microelectromechanical microphone of claim 11, wherein the multiplexer device generates a first bit of the first bit stream at a first edge of the timing signal, and further generates a second bit of the second bit stream at a second edge of the timing signal.

13. The microelectromechanical microphone of claim 7, further comprising:

a first event detector device configured to determine that an audible event occurred, and further configured to generate a first interrupt signal in response to the audible event; and a second event detector device configured to determine that an ultrasonic event occurred, and further configured to generate a second interrupt signal in response to the ultrasonic event.

14. The microelectromechanical microphone of claim 13, further comprising a multiplexer device that multiplexes the first interrupt signal and the second interrupt signal.

15. The microelectromechanical microphone of claim 7, further comprising a memory device configured to store at least one of a portion of the digital output signal representative of the audible signal or a portion of the digital output signal representative of the ultrasonic signal.

16. The microelectromechanical microphone of claim 7, wherein the programming input signal is an operation that causes the low-pass sigma-delta modulator to introduce a defined quantity of quantization noise to the audible signal.

17. The microelectromechanical microphone of claim 7, wherein the programming input signal is an operation indicative of a noise-shaping configuration to be implemented by one of the band-pass sigma-delta modulator and the low-pass sigma-delta modulator.

18. The microelectomechanical microphone of claim 17, wherein the operation causes the band-pass sigma-delta modulator to be reconfigured from a first type of noise shaping to a second type of noise shaping.

19. The microelectomechanical microphone of claim 17, wherein the operation causes the low-pass sigma-delta modulator to be reconfigured from a first type of noise shaping to a second type of noise shaping.

* * * * *